US006562551B1

(12) United States Patent
Porter et al.

(10) Patent No.: US 6,562,551 B1
(45) Date of Patent: May 13, 2003

(54) GRIPPING MULTI-LEVEL BLACK MATRIX

(75) Inventors: John D. Porter, Berkeley, CA (US); Bob L. Mackey, San Jose, CA (US); Robert G. Neimeyer, San Jose, CA (US); Christopher J. Spindt, Menlo Park, CA (US); David C. Chang, San Francisco, CA (US); Kris E. Sahlstrom, Santa Cruz, CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/585,712

(22) Filed: May 31, 2000

(51) Int. Cl.[7] ..... H01J 29/18

(52) U.S. Cl. ..... 430/321; 430/330; 445/24; 313/495; 216/25; 216/49

(58) Field of Search ..... 430/321, 314, 430/330, 317, 318, 319; 445/24; 313/495; 216/49, 25

(56) References Cited

U.S. PATENT DOCUMENTS 5,543,683 A * 8/1996 Haven et al. ..... 313/461
5,858,619 A * 1/1999 Chang et al. ..... 430/312
5,931,713 A 8/1999 Watkins et al. ..... 445/55

* cited by examiner

*Primary Examiner*—John A. McPherson
(74) *Attorney, Agent, or Firm*—Wagner, Murabito & Hao LLP

(57) ABSTRACT

A multi-level matrix structure for retaining a support structure within a flat panel display device. In one embodiment, the multi-level matrix structure is comprised of a first parallel ridges. The multi-level matrix structure further includes a second parallel ridges. The second parallel ridges are oriented substantially orthogonally with respect to the first parallel ridges. In this embodiment, the second parallel ridges have a height which is greater than the height of the first parallel ridges. Furthermore, in this embodiment, the second plurality of parallel spaced apart ridges include contact portions for retaining a support structure at a desired location within a flat panel display device. Hence, when a support structure is inserted between at least two of the contact portions of the multi-level support structure, the support structure is retained in place, at a desired location within the flat panel display device, by the contact portions.

68 Claims, 28 Drawing Sheets

GRIPPING MULTI-LEVEL BLACK MATRIX

FIELD OF THE INVENTION

The present claimed invention relates to the field of flat panel or field emission displays. More particularly, the present claimed invention relates to the black matrix of a flat panel display screen structure.

BACKGROUND ART

Sub-pixel regions on the faceplate of a flat panel display are typically separated by an opaque mesh-like structure commonly referred to as a black matrix. By separating light emitting sub-pixel regions with a light-absorbing mask, the black matrix increases contrast ratio in bright ambient environments. It can also prevent electrons directed at one sub-pixel from being "back-scattered" and striking another sub-pixel. In so doing, a conventional black matrix helps maintain a flat panel display with sharp resolution. In addition, the black matrix is also used as a base on which to locate support structures such as, for example, support walls.

In most prior art approaches, the support structures are connected to the black matrix using an adhesive. However, such prior art approaches have significant drawbacks associated therewith. As an example, in many prior art approaches it is necessary to precisely position the support structure with respect to the black matrix. More specifically, in some embodiments, complex alignment equipment must be used to ensure that the base of the support structure is being placed precisely onto a desired location on the black matrix. Such a problem is exacerbated when the support structure spans the entire length or width of the black matrix.

In addition to precisely placing the support structure at a desired location with respect to the black matrix, it is also necessary to keep the support structure at the precise location and with a desired orientation (e.g. not tilted or sloping) during subsequent processing steps. For example, if the base of the support structure is precisely positioned with respect to the black matrix, the top of the support structure must be kept from tilting until the top of the support structure is affixed to its designated anchor point. Such maintenance of the position of the support structure is critical to ensuring that the support structure functions properly. In one attempt to keep the support structure at a desired location, the black matrix has been used as a coarse positioning or "buttressing" tool. Such an approach is described in commonly-owned U.S. Pat. No. 5,858,619 to Chang et al., entitled "Multi-Level Conductive Matrix Formation Method", issued Jan. 12, 1999. Although the teachings of the Chang et al. patent are beneficial, the invention of the Chang et al. patent does not provide the type of support necessary to ensure that the support structure is kept at the precise location and with a desired orientation (e.g. not tilted or sloping) during subsequent processing steps. The Chang et al. patent is incorporated herein as background material.

In other prior art attempts to solve some of the aforementioned problems, large amounts of adhesive are applied to, for example, the base of the support structure to securely affix the support structure to the top surface of the black matrix. However, such adhesives render adjusting or correcting of the position of the support structures difficult, tedious, or impractical. Also some prior art adhesives may deleteriously outgas contaminants into the evacuated active environment of the flat panel display device. As a result, certain types of adhesives may not be practical for use with flat panel display fabrication.

Additionally, although the aforementioned commonly-owned U.S. Pat. No. 5,858,619 to Chang et al., entitled "Multi-Level Conductive Matrix Formation Method", issued Jan. 12, 1999 describes a method for forming a matrix structure, the invention of the Chang et al. patent does not provide the type of support necessary to form contact portions for ensuring that the support structure is kept at the precise location and with a desired orientation (e.g. not tilted or sloping) during subsequent processing steps. As mentioned above, Chang et al. patent is incorporated herein as background material. That is, conventional matrix formation methods do not even remotely suggest or address formation of contact portions of a matrix structure.

Thus, a need exists for a black matrix structure formation method which eliminates the need for precise positioning of the support structure. A further need exists for a black matrix structure formation method which alleviates the problems associated with maintaining the support structure in a precise location and orientation during subsequent manufacturing steps. Still another need exists for black matrix structure formation method which eliminates the need for large quantities of tedious and polluting adhesives to hold the support structure in place.

Furthermore, in addition to the need for a black matrix formation method which meets the above-listed requirements, a need also exists for a black matrix formation method which produces a black matrix which is electrically robust. That is, a need also exists for a black matrix formation method which produces a black matrix structure which is adapted to retain a support structure within a flat panel display device, and which exhibits desired electrical characteristics even under electron bombardment during operation of the flat panel display device.

SUMMARY OF INVENTION

The present invention provides, in one embodiment, a black matrix structure which substantially reduces the need for precise positioning of the support structure by external means. The present embodiment further provides a black matrix structure which alleviates the problems associated with maintaining the support structure in a precise location and orientation during subsequent manufacturing steps. The present embodiment further provides a structure which eliminates the need for large quantities of tedious and polluting adhesives to hold the support structure in place.

Specifically, in one embodiment, the present invention provides a multilevel structure comprised, in part, of a first plurality of substantially parallel spaced apart ridges (hereinafter also referred to as first plurality of parallel ridges). That is, the first ridges are spaced apart in a substantially parallel orientation. The multi-level matrix structure further includes a second plurality of substantially parallel spaced apart ridges (hereinafter also referred to as a second plurality of parallel ridges). That is, the second ridges are spaced apart in a substantially parallel orientation. The second parallel ridges are oriented substantially orthogonally with respect to the first parallel ridges. In this embodiment, the second parallel ridges have a height which is greater than the height of the first parallel ridges. Furthermore, in this embodiment, the second plurality of parallel spaced apart ridges include contact portions for retaining a support structure at a desired location within a flat panel display device. Hence, when a support structure is inserted between at least two of the contact portions of the multi-level support structure, the support structure is retained in place, at a desired location within the flat panel display device, by the contact portions.

The present invention provides, in one embodiment, a black matrix structure formation method which substantially reduces the need for precise positioning of the support structure. The present embodiment further provides a black matrix structure formation method which alleviates the problems associated with maintaining the support structure in a precise location and orientation during subsequent manufacturing steps. The present invention also provides, in one embodiment, black matrix structure formation method which substantially reduces the need for large quantities of tedious and polluting adhesives to hold the support structure in place.

Specifically, the present invention provides a method for forming a contact portion of a matrix structure wherein the contact portion is adapted to locate and retain a support structure within a flat panel display device. In this embodiment, the present invention disposes a polyimide precursor material up on a substrate. The substrate is a substrate to which cured polyimide material is strongly adherent. Next, the present embodiment subjects the polyimide precursor material to a thermal imidization process such that an extending region of the cured polyimide material is formed proximate to the substrate. Upon the completion of the thermal imidization process, the present embodiment selectively etches the substrate to undercut the substrate from beneath the extending region of the cured polyimide material. As a result, the extending region of the cured polyimide material comprises the contact portion of the matrix structure. In this embodiment, the extending region of the cured polyimide material is adapted to retain a support structure within the flat panel display device.

In another embodiment, the present invention provides a method for forming a multi-layer heterostructure contact portion of a matrix structure wherein the multi-layer heterostructure contact portion is adapted to retain a support structure within a flat panel display device. More specifically, in this embodiment, the present invention disposes a polyimide precursor material upon a first surface of a first substrate. The first surface of the first substrate is comprised of a material to which cured polyimide material is strongly adherent. Next, the present embodiment subjects the polyimide precursor material to a thermal imidization process such that an extending region of the cured polyimide material is formed proximate to the first surface of the first substrate and such that a retracted region of the cured polyimide material is formed distant from the first surface of the first substrate. In the present embodiment, the first surface of the first substrate comprises a first part of the multi-layer heterostructure contact portion of the matrix structure. The first surface of the first substrate is adapted to retain a support structure within the flat panel display device.

In yet another embodiment, the multi-layer heterostructure contact portion is formed using a plurality of substrates which have cured polyimide disposed therebetween. The multi-layer heterostructure contact portion is fabricated in a manner similar to that described in the previously described embodiment. In the present embodiment, the plurality of substrates comprise the multi-layer heterostructure contact portion of the matrix structure, and are adapted to retain a support structure within the flat panel display device.

In another embodiment, the present invention provides a black matrix formation method which meets the above-listed requirements, and which produces a black matrix which is electrically robust. That is, another embodiment of the present invention provides a black matrix formation method which produces a black matrix structure which is adapted to retain a support structure within a flat panel display device, and which exhibits desired electrical characteristics even under electron bombardment during operation of the flat panel display device.

Specifically, in the present embodiment, the present invention forms a first plurality of substantially parallel spaced apart conductive ridges above a surface to be used within a flat panel display device. The present embodiment then forms a second parallel ridges above the surface to be used within a flat panel display device. The second parallel ridges are oriented substantially orthogonally with respect to the first plurality of substantially parallel spaced apart conductive ridges. Additionally, in this embodiment, the second parallel ridges having a height which is greater than the height of the first plurality of substantially parallel spaced apart conductive ridges. Also, the second plurality of parallel spaced apart ridges including contact portions for retaining a support structure at a desired location within a flat panel display device. Next, the present embodiment applies a dielectric material to the first plurality of substantially parallel spaced apart conductive ridges. The present embodiment then removes a portion of the dielectric material from the first plurality of substantially parallel spaced apart conductive ridges such that an exposed region of the first plurality of substantially parallel spaced apart conductive ridges is generated. Then, the present embodiment deposits a layer of conductive material over the first plurality of substantially parallel spaced apart conductive ridges such that the conductive material is electrically coupled to the exposed region of the first plurality of substantially parallel spaced apart conductive ridges.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
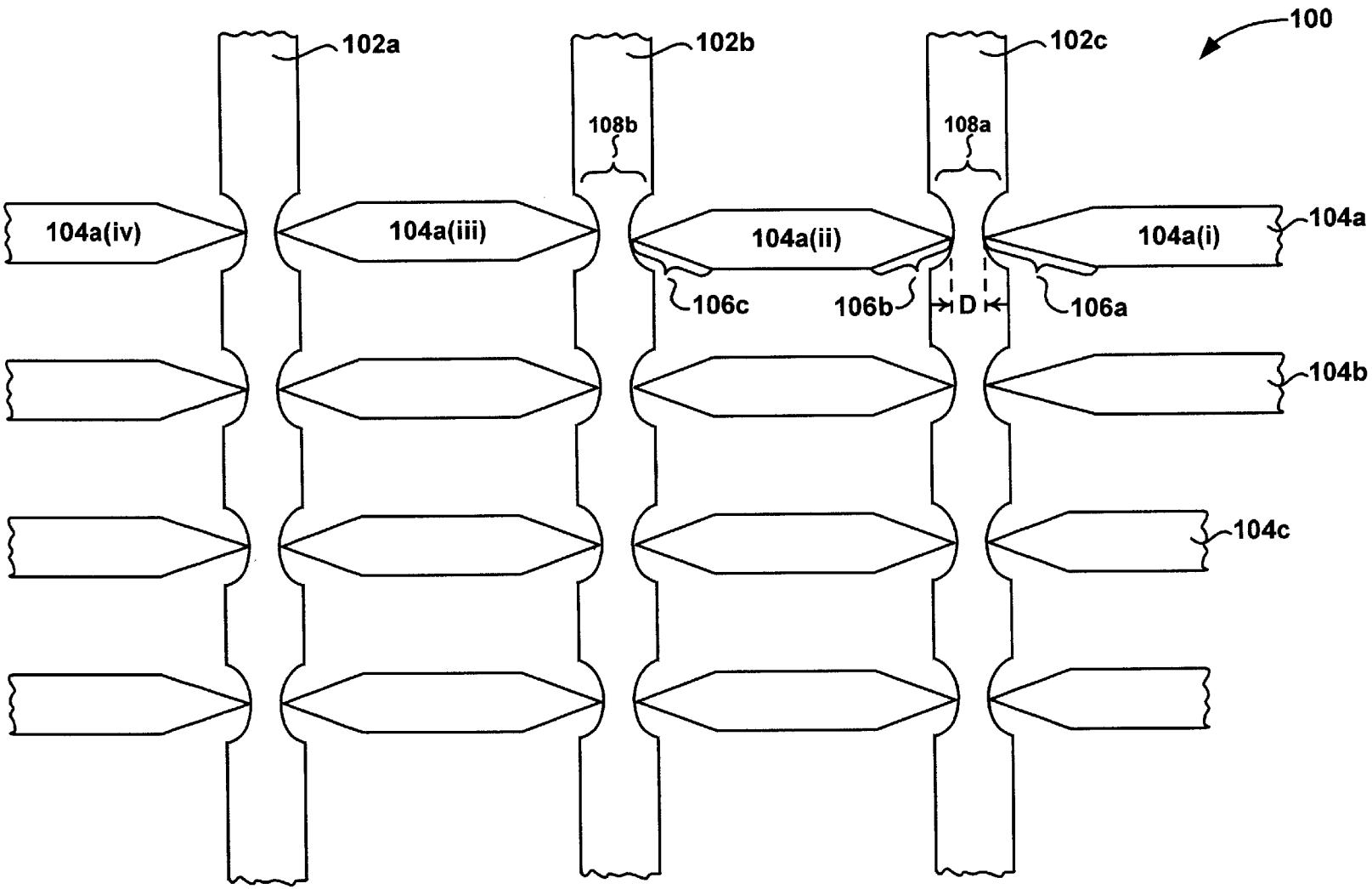
FIG. 1 is a top plan view of a multi-level matrix structure in accordance with one embodiment of the present claimed invention.

With reference to FIG. 1 of the present embodiment, a top plan view of a multi-level matrix structure 100 in accordance with the present claimed invention is shown. The present invention is comprised of a multi-level black matrix for separating rows and columns of sub-pixels on the faceplate of a flat panel display device. Although the present invention is referred to as a black matrix, it will be understood that the term "black" refers to the opaque characteristic of the matrix. Thus, the present invention is also well suited to having a color other than black. Additionally, although the present embodiment is described as being disposed for separating rows and columns of sub-pixels on the faceplate of a flat panel display device (e.g. a field emission display device), the present embodiment is also well suited to having multi-level matrix 100 disposed above a cathode of the flat panel display device. Furthermore, the various embodiments of the present invention are also well suited to having a reflective layer of material (e.g. aluminum) disposed completely over the top surface thereof.

Referring still to FIG. 1, in the present embodiment, multi-level black matrix 100 is adapted for use in a field emission display type of flat panel display device. More specifically, as will be described below in detail, multi-level matrix structure 100 of the present invention is particularly configured to retain a support structure in a desired location and orientation within a field emission display device. In the embodiment of FIG. 1, multi-level matrix structure 100 is comprised of, for example, a CB800A DAG made by Acheson Colloids of Port Huron, Mich. One method of forming a multi-level black matrix is recited in commonly-owned U.S. Pat. No. 5,858,619 to Chang et al., entitled "Multi-Level Conductive Matrix Formation Method", issued Jan. 12, 1999. The Chang et al. patent is incorporated herein as background material. Although such materials and formation methods are recited and incorporated by reference above, the present invention is also well suited to the use of various other types of material and to being formed using any of various other available formation methods.

With reference still to FIG. 1, multi-level matrix 100 of the present embodiment is comprised of a first parallel ridges typically shown as 102*a*, 102*b*, and 102*c*. In the embodiment of FIG. 100, first parallel ridges 102*a*, 102*b*, and 102*c* are located between adjacent columns of subpixels. Multi-level matrix 100 also includes a second parallel ridges, typically shown as 104*a*, 104*b*, and 104*c*. In the embodiment of FIG. 1, second parallel ridges, 104*a*, 104*b*, and 104*c* are each comprised of sections. For example, substantially parallel spaced apart ridge 104*a* is comprised of sections 104*a*(i), 104*a*(ii), 104*a*( iii), and 104*a*(iv). Substantially parallel spaced apart ridges 104*b* and 104*c* are similarly comprised of sections.

As shown in FIG. 1, second parallel ridges 104*a*, 104*b*, and 104*c* are oriented substantially orthogonally with respect to first parallel ridges 102*a*, 102*b*, and 102*c*. Also, in the present embodiment, second parallel ridges 104*a*, 104*b*, and 104*c* have a height greater than the height of first parallel ridges 102*a*, 102*b*, and 102*c*.

Referring still to FIG. 1, second plurality of parallel spaced apart ridges including contact portions, typically shown as 106*a*, 106*b*, and 106*c*. In the present embodiment, contact portions 106*a*, 106*b*, and 106*c* are located on the ends of each section of second parallel ridges 104*a*, 104*b*, and 104*c*. As will be further described below, contact portions 106*a*, 106*b*, and 106*c* of the present embodiment are adapted to retain a support structure at a desired location and orientation within a field emission display device.

In multi-level matrix structure 100 of FIG. 1, first parallel ridges 102*a*, 102*b*, and 102*c* may have an indentation or recessed region, typically shown as 108*a* and 108*b*, where first parallel ridges 102*a*, 102*b*, and 102*c* intersect second parallel ridges 104*a*, 104*b*, and 104*c*. More particularly, in the present embodiment, contact portions 106*a*, 106*b*, and 106*c* of second parallel ridges 104*a*, 104*b*, and 104*c* extend into recessed regions 108*a* and 108*b*. As an example, contact portions 106*a* and 106*b* extend into recessed region 108*a* of ridge 102*c*. Moreover, in the present embodiment, contact portions 106*a* and 106*b* on second parallel ridges 104*a*, 104*b*, and 104*c* extend towards each other (i.e. into recessed regions 108*a* and 108*b*) such that the distance between opposing contact portions is substantially less than the thickness of a support structure. That is, the distance, D, between the contact portions is less than the thickness of first parallel ridges, 102*a*, 102*b*, and 102*c*, and less than the thickness of a support structure which will ultimately reside on at least one of first parallel ridges, 102*a*, 102*b*, and 102*c*. Although recessed regions 108*a* and 108*b* are shown as semi-circular in the present embodiment, the present invention is also well suited to an embodiment in which recessed regions 108*a* and 108*b* are shaped other than semi-circular. In one embodiment, recessed regions 108*a* and 108*b* are formed to have a contour which closely matches the shape of the contact portions extending therein (see e.g. the embodiment of FIG. 3).

Figure 2:
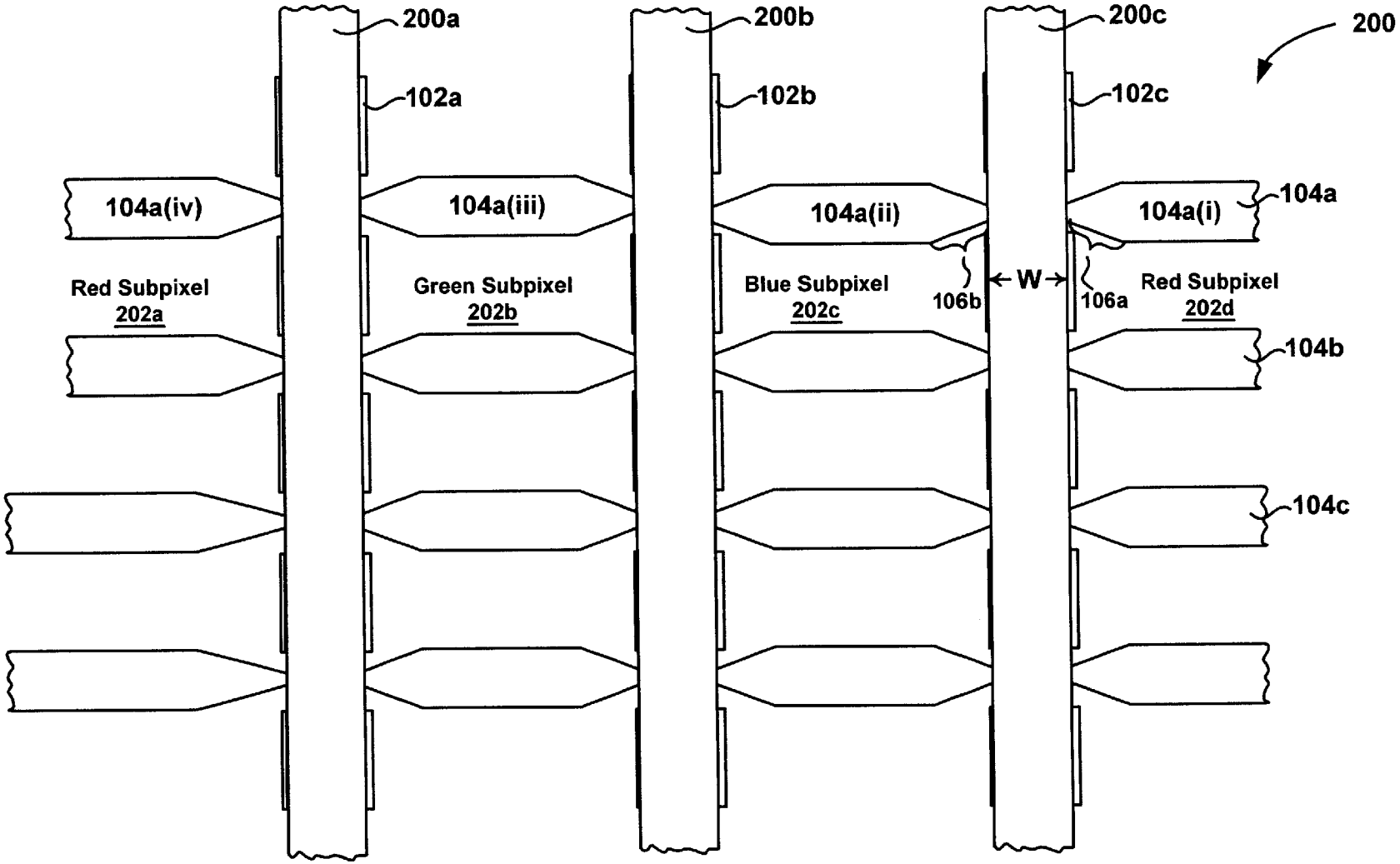
FIG. 2 is a top plan view of the multi-level matrix structure of FIG. 1 having a support structure disposed thereon in accordance with another embodiment of the present claimed invention.

With reference now to FIG. 2, the multi-level matrix structure 100 of FIG. 1 is shown having support structures, typically shown as 200*a*, 200*b*, and 200*c*, retained thereon. In the present embodiment, support structures 200*a*, 200*b*, and 200*c* are comprised of wall type support structures. Although such support structures are specifically recited in the present embodiment, the present invention is also well suited to the use of various other types of support structures including, but not limited to, posts, crosses, pins, wall segments, T-shaped objects, and the like.

Referring again to FIG. 2, support structures 200*a*, 200*b*, and 200*c* have a width, W, which is greater than the distance, D, between opposing contact portions. As a result, when a support structure is pressed between the contact portions and towards the top surface of first parallel ridges, 102*a*, 102*b*, and 102*c*, the contact portions (e.g. contact portions 106*a* and 106*b*) contact the support structures (e.g. support structure 200*c*) on opposing sides thereof. In so doing, the present invention provides a multi-level matrix structure 100 which "grips" support structures and retains the support structures in a precise location and orientation during subsequent manufacturing steps. That is, the present invention provides, in this embodiment, a frictional contact fit for the support structure between opposing contact portions of second parallel ridges, 104*a*, 104*b*, and 104*c*. Although the present embodiment specifically recites that the support structures 200*a*, 200*b*, and 200*c* have a width, W, which is greater than the distance, D, between opposing contact portions, the present embodiment is also well suited to an embodiment in which support structures 200*a*, 200*b*, and 200*c* have a width, W, which is less than the distance, D, between opposing contact portions. In such an embodiment, a "wavy" or "serpentine" shaped support structure may actually be frictionally retained between contact portions which are not disposed directly across from each other. That is, one contact portion may contact the serpentine support structure at the "peak or maxima of its amplitude" while a second contact portion may contact the serpentine support structure at the "trough or minima of its amplitude".

Furthermore, although not specifically repeated during each discussion of the various embodiments of the present invention for purposes of brevity and clarity, each of the embodiments described in this application are suited to having the contact portion or portions frictionally retain the support structure at a desired location and/or orientation within the flat panel display device. More specifically, in various embodiments, the contact portions apply several grams of force (e.g. approximately 50–1000 grams of force) to the support structure. This force is applied in the transverse and/or axial direction in various quantities.

Additionally, in one embodiment, contact portions 106*a*, 106*b*, and 106*c*, include deformable ends which compress when pressed against support structures 200*a*, 200*b*, and 200*c*. By compressing, the contact portions are able to provide pressure to the support structure along a greater surface area. Additionally, the compressibility of the contact portions increases the tolerance of the multi-level matrix structure for accepting support structures of various widths. Furthermore, by providing compressibility, an increased tolerance is provided when forming second parallel ridges, 104*a*, 104*b*, and 104*c*.

Referring again to FIGS. 1 and 2, in this embodiment, contact portions 106*a*, 106*b*, and 106*c* of multi-level matrix structure 100 include sharp ends which are adapted to be pressed against support structures 200*a*, 200*b*, and 200*c*. In some instances, support structures 200*a*, 200*b*, and 200*c* have a material (e.g. a thin layer of aluminum) disposed along at least the bottom edges thereof. By having sharp ends, contact portions 106*a*, 106*b*, and 106*c* cleanly cut through material disposed on support structures 200*a*, 200*b*, and 200*c*. Thus, the material does not substantially peel from support structures 200*a*, 200*b*, and 200*c* as support structures 200*a*, 200*b*, and 200*c* are forced against the sharp ends of contact portions 106*a*, 106*b*, and 106*c*.

As a substantial advantage of the present invention, the contact fit provided by contact the portions substantially reduces the need for precise positioning of the support structure. That is, instead of meticulously arranging the support structures at a precise location on or above second parallel ridges, 104*a*, 104*b*, and 104*c*, the support structures are mechanically pressed between opposing contact portions. Hence, the contact portions guide the support structures to the correct location and then maintain the support structures at the desired location and in the desired orientation. As yet another benefit, by employing a contact fit provided by opposing contact portions, the present invention eliminates the need for large quantities of tedious and polluting adhesives to hold the support structures in place.

Figure 3:
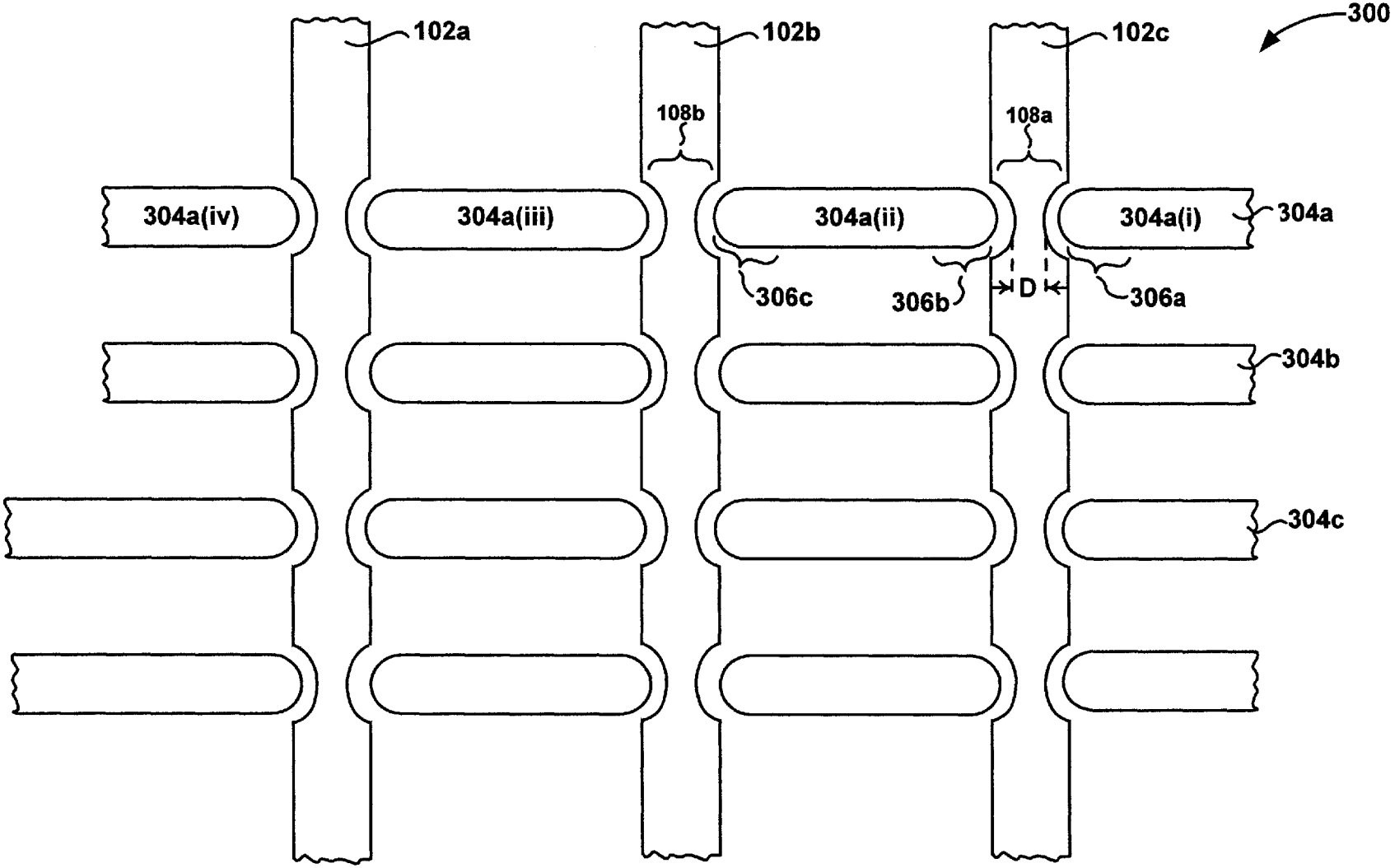
FIG. 3 is a top plan view of a multi-level matrix structure in accordance with yet another embodiment of the present claimed invention.

With reference now to FIG. 3, another embodiment of the present invention is shown. In the embodiment of FIG. 3, multi-level black matrix 300 is comprised of a first parallel ridges typically shown as 102*a*, 102*b*, and 102*c*. In the embodiment of Figure 100, first parallel ridges 102*a*, 102*b*, and 102*c* are located between adjacent columns of subpixels. Multi-level matrix 100 also includes a second parallel ridges, typically shown as 304*a*, 304*b*, and 304*c*. In the embodiment of FIG. 3, second parallel ridges, 304*a*, 304*b*, and 304*c* are each comprised of sections. For example, substantially parallel spaced apart ridge 304*a* is comprised of sections 304*a*(i), 304*a*(ii), 304*a*(iii), and 304*a*(iv). Substantially parallel spaced apart ridges 104*b* and 104*c* are similarly comprised of sections.

As shown in FIG. 3, second parallel ridges 304*a*, 304*b*, and 304*c* are oriented substantially orthogonally with respect to first parallel ridges 102*a*, 102*b*, and 102*c*. Also, in the present embodiment, second parallel ridges 304*a*, 304*b*, and 304*c* have a height greater than the height of first parallel ridges 102*a*, 102*b*, and 102*c*.

Referring still to FIG. 3, second plurality of parallel spaced apart ridges including contact portions, typically shown as 306*a*, 306*b*, and 306*c*. In the present embodiment, contact portions 306*a*, 306*b*, and 306*c* care located on the ends of each section of second parallel ridges 304*a*, 304*b*, and 304*c*. In a manner as was described above in conjunction with the embodiment of FIGS. 1 and 2, contact portions 306*a*, 306*b*, and 306*c* of the present embodiment are adapted to retain a support structure at a desired location and orientation within a field emission display device.

In multi-level matrix structure 300 of FIG. 3, first parallel ridges 102*a*, 102*b*, and 102*c* have an indentation or recessed region, typically shown as 108*a* and 108*b*, where first parallel ridges 102*a*, 102*b*, and 102*c* intersect second parallel ridges 304*a*, 304*b*, and 304*c*. More particularly, in the present embodiment, contact portions 306*a*, 306*b*, and 306*c* of second parallel ridges 304*a*, 304*b*, and 304*c* extend into recessed regions 108*a* and 108*b*. As an example, contact portions 306*a* and 306*b* extend into recessed region 108*a* of ridge 102*c*. Moreover, in the present embodiment, contact portions 306*a* and 306*b* on second parallel ridges 304*a*, 304*b*, and 304*c* extend towards each other (i.e. into recessed regions 108*a* and 108*b*) such that the distance between opposing contact portions is substantially less than the thickness of a support structure. That is, the distance, D, between the contact portions is less than the thickness of first parallel ridges, 102*a*, 102*b*, and 102*c*, and less than the thickness of a support structure which will ultimately reside on at least one of first parallel ridges, 102*a*, 102*b*, and 102*c*. In the present embodiment, recessed regions 108*a* and 108*b* have a contour which closely matches the shape of the contact portions extending therein. Additionally, in one embodiment, contact portions 306*a*, 306*b*, and 306*c*, include deformable ends which compress when pressed against support structures.

Figure 4:
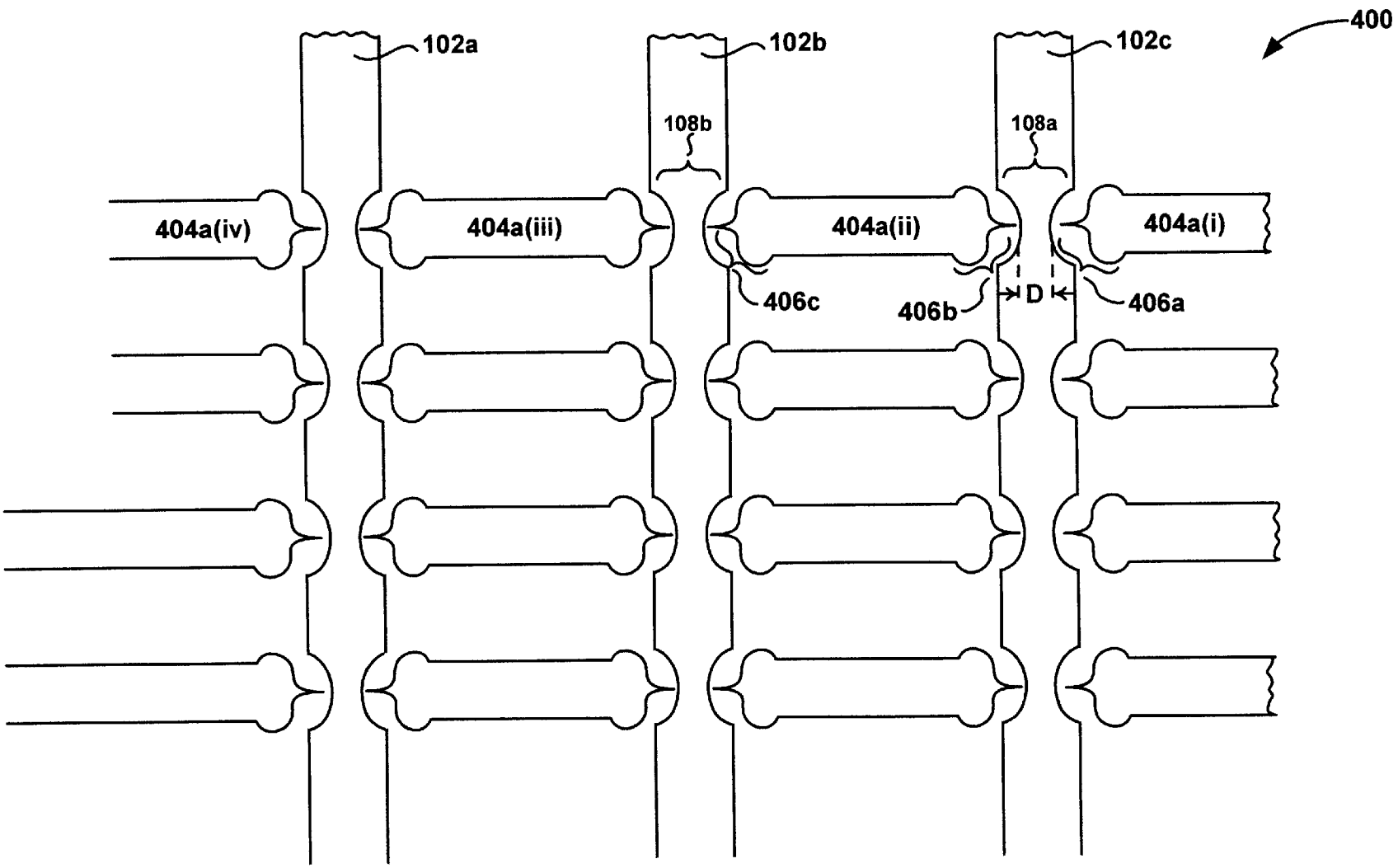
FIG. 4 is a top plan view of yet another multi-level matrix structure in accordance with one embodiment of the present claimed invention.

With reference still to FIG. 4, another embodiment of a multi-level black matrix 400 in accordance with the present invention is shown. The embodiment of FIG. 4 is structured similarly to the embodiment of FIGS. 1, 2, and 3 described in detail above. In this embodiment, contact portions 406*a*, 406*b*, and 406*c* of multi-level matrix structure 400 include sharp ends which are adapted to be pressed against support structures. In some instances, the support structures will have a material (e.g. a thin layer of aluminum) disposed along at least the bottom edges thereof. By having sharp ends, contact portions 406*a*, 406*b*, and 406*c* will cleanly cut through material disposed on the support structures. Thus, the material will not substantially peel from the support structures when they are forced against the sharp ends of contact portions 406*a*, 406*b*, and 406*c*. Additionally, in one embodiment, contact portions 406*a*, 406*b*, and 406*c*, include deformable ends which compress when pressed against support structures.

Although three specific embodiments are shown and discussed in the present application, the present invention is not limited to those specific configurations. Rather, the present multi-level black matrix for retaining a support structure, is well suited to being configured with any of a myriad of differently shaped sections, contact portions, recessed regions, and the like. Furthermore, although the contact portions are disposed on the horizontally oriented portion of the multi-level black matrix (i.e. the second parallel ridges), the present invention is also well suited to an embodiment in which the contact portions are disposed on the vertically oriented portion of the multi-level black matrix (i.e. the first parallel ridges) and the recessed regions are formed into the second parallel ridges.

In another embodiment, the multi-level black matrix of the present invention is encapsulated with a protective material such as, for example, silicon nitride. By encapsulating the present multi-level black matrix, several significant advantages are realized. For example, encapsulation of the multi-level black matrix extends the life of the display by reducing electron-induced outgassing. This feat is accomplished primarily in one of two manners. First, electron-induced outgassing is reduced by the encapsulation material intercepting electrons before they contact the encapsulated component (e.g. the multi-level black matrix). Second, electron-induced outgassing is reduced by the encapsulation material containing gases which would be released by such electron contact with the encapsulated component (e.g. the multi-level black matrix).

In the embodiment of FIG. 2, support structures 200*a*, 200*b*, and 200*c* are shown disposed between each of the subpixels (i.e. between the red subpixel 202*a* and the green subpixel 202*b*, between green subpixel 202*b* and the blue subpixel 202*c*, and between blue subpixel 202*c* and the red subpixel 202*d*). In one embodiment of the present invention, however, a support structure is disposed only between red and blue subpixels (e.g. between blue subpixel 202*c* and red subpixel 202*d*). Although not shown in FIG. 2 for purposes of clarity, the spacing between subpixels residing within the same pixel is consistent. To the contrary, the spacing between a red subpixel of a first pixel and the blue subpixel of an adjacent pixel is greater than the spacing between adjacent subpixels residing in the same pixel. In the present embodiment, by locating a support structure in the larger "gap" present between a red subpixel of a first pixel and the blue subpixel of an adjacent pixel, the visibility of support structures (e.g. a support wall) is minimized. More specifically, in terms of pixels, the human eye is most sensitive to detecting a pattern (e.g. a series of support structures) when the pattern is located next to a green subpixel; the human eye is less sensitive to detecting a pattern (e.g. a series of support structures) when the pattern is located next to a red subpixel; and the human eye is even less sensitive to detecting a pattern (e.g. a series of support structures) when the pattern is located next to a blue subpixel. Thus, by placing a support structure only between the red and blue subpixels, the visibility of the support structures is minimized.

Figure 5:
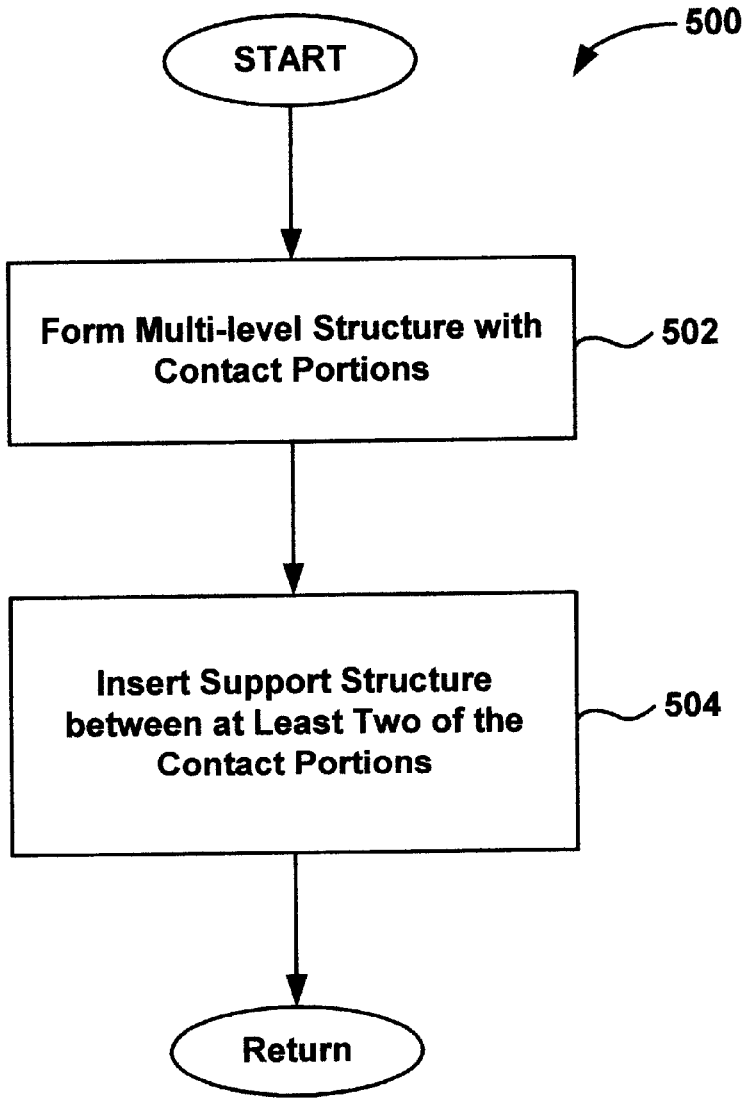
FIG. 5 is a flow chart of steps performed in accordance with one embodiment of the present claimed invention.

With reference now to FIG. 5, a flow chart 500 of steps performed to retaining a support structure within a flat panel display device in accordance with one embodiment of the present invention is shown. As recited at step 502, in the present embodiment, the present invention forms a multi-level matrix structure.

Referring still to step 502, one method of forming a multi-level black matrix is recited in commonly-owned U.S. Pat. No. 5,858,619 to Chang et al., entitled "Multi-Level Conductive Matrix Formation Method", issued Jan. 12, 1999 and which is incorporated herein by reference. Specifically, in one embodiment, the present invention forms first pixel separating structures across a surface of a faceplate of a flat panel display. The first pixel separating structures separate adjacent first sub-pixel regions. In this embodiment, the first pixel separating structures are formed by applying a first layer of photo-imagable material across the surface of the faceplate. Next, portions of the first layer of photo-imagable material are removed to leave regions of the first layer of photo-imagable material covering respective first sub-pixel regions. Then, a first layer of material is applied over the surface of the faceplate such that the first layer of material (comprising e.g. the first parallel ridges) is disposed between the aforementioned regions of the first layer of photo-imagable material. The present invention then removes the regions of the first layer of photo-imagable material leaving only first pixel separating structures formed of the first layer of material, disposed between the first sub-pixel regions. The present invention performs similar steps in order to form second pixel separating structures (comprising e.g. the second parallel ridges) between the second sub-pixel regions. The second pixel separating structures are formed substantially orthogonally oriented with respect to the first pixel separating structures and, in the present embodiment, have a different height than the first pixel separating structures and have contact portions with features and dimensions as is described above in conjunction with the description of FIGS. 1–4. In so doing, a multi-level black matrix structure for retaining a support structure at a desired position and orientation is formed.

In the present embodiment, the layer of photo-imagable material is comprised of photoresist such as, for example, AZ4620 Photoresist, available from Hoechst-Celanese of Somerville, N.J. It will be understood, however, that the present invention is well suited to the use of various other types and suppliers of photo-imagable material. The layer of photoresist is deposited to a depth of approximately 10–20 microns in the present embodiment.

In yet another embodiment, the present invention deposits a first pixel separating structure onto a surface of a faceplate of a flat panel display device. The first pixel separating structure is disposed on the surface of the faceplate such that the first pixel separating structure separates first sub-pixel regions. In this embodiment, the first pixel separating structure is formed by repeatedly applying layers of material over the surface of the faceplate until the first pixel separating structure is formed having a desired height between the first sub-pixel regions. Next, the present invention deposits a second pixel separating structure onto the surface of the faceplate. In the present embodiment, the second pixel separating structure is formed by repeatedly applying layers of material over the surface of the faceplate until the second pixel separating structure is formed having a desired height between the second sub-pixel regions. The second pixel separating structure is disposed on the surface of the faceplate such that the second pixel separating structure is orthogonally oriented with respect to the first pixel separating structure.

In this embodiment, the layer of material which is repeatedly applied over the surface of the faceplate is comprised, for example, of a CB800A DAG made by Acheson Colloids of Port Huron, Mich. In such an embodiment, the height of second parallel ridges is approximately 40–50 micrometers tall to ensure that the contact portions of the second parallel ridges retain the support structure in the desired location. In one embodiment, the layer of material is comprised of a graphite-based material. In still another embodiment, the layer of graphite-based material is applied as a semi-dry spray to reduce shrinkage of the layer of material and ensure that the contact portions of the second parallel ridges retain the support structure in the desired location. In so doing, the present invention allows for improved control over the final depth of layer of the first parallel ridges, reduced shrinkage of the second parallel ridges, and improved control over the height of the second parallel ridges. Although such deposition methods are recited above, it will be understood that the present invention is also well suited to using various other deposition methods to deposit various other materials.

Referring still to step 502, in summary, the present embodiment forms a first parallel ridges and a second parallel ridges. The second parallel ridges are oriented substantially orthogonally with respect to the first parallel ridges. Additionally, in this embodiment, the second parallel ridges have a height which is greater than the height of the first parallel ridges. The second plurality of parallel spaced apart ridges further include contact portions for retaining a support structure at a desired location within a flat panel display device.

Referring still to step 502, in this embodiment, the multi-level matrix structure is formed above an inner surface of a faceplate of the flat panel display device. However, the present invention is also well suited to forming the multi-level matrix structure above a cathode of the flat panel display device. Additionally, the present embodiment forms the multi-level matrix structure such that the aforementioned contact portions are disposed with two of the contact portions adapted to contact a support structure on opposing sides thereof. Also, in one embodiment, the present multi-level black matrix is formed with contact portions which include deformable ends which compress when pressed against the support structure. Also, in one embodiment, the present invention forms the multi-level matrix structure such that the contact portions include sharp ends which are adapted to be pressed against a support structure. In such an embodiment, the sharp ends are adapted to cleanly cut through material disposed on the support structure such that the material does not substantially peel from the support structure as the support structure is inserted between at least two of the contact portions of the multi-level matrix structure. In another embodiment, the present invention also encapsulates the first and second parallel ridges with a protective material such as, for example, silicon nitride.

With reference now to step 504, the present embodiment then inserts a support structure between at least two of the contact portions of the multi-level support structure such that the support structure is pressed between and retained by the contact portions at the desired location within the flat panel display device. Additionally in one embodiment, the present invention inserts the support structure only between red subpixels and blue subpixels of the flat panel display device such that visibility of the support structure is minimized.

Figure 6:
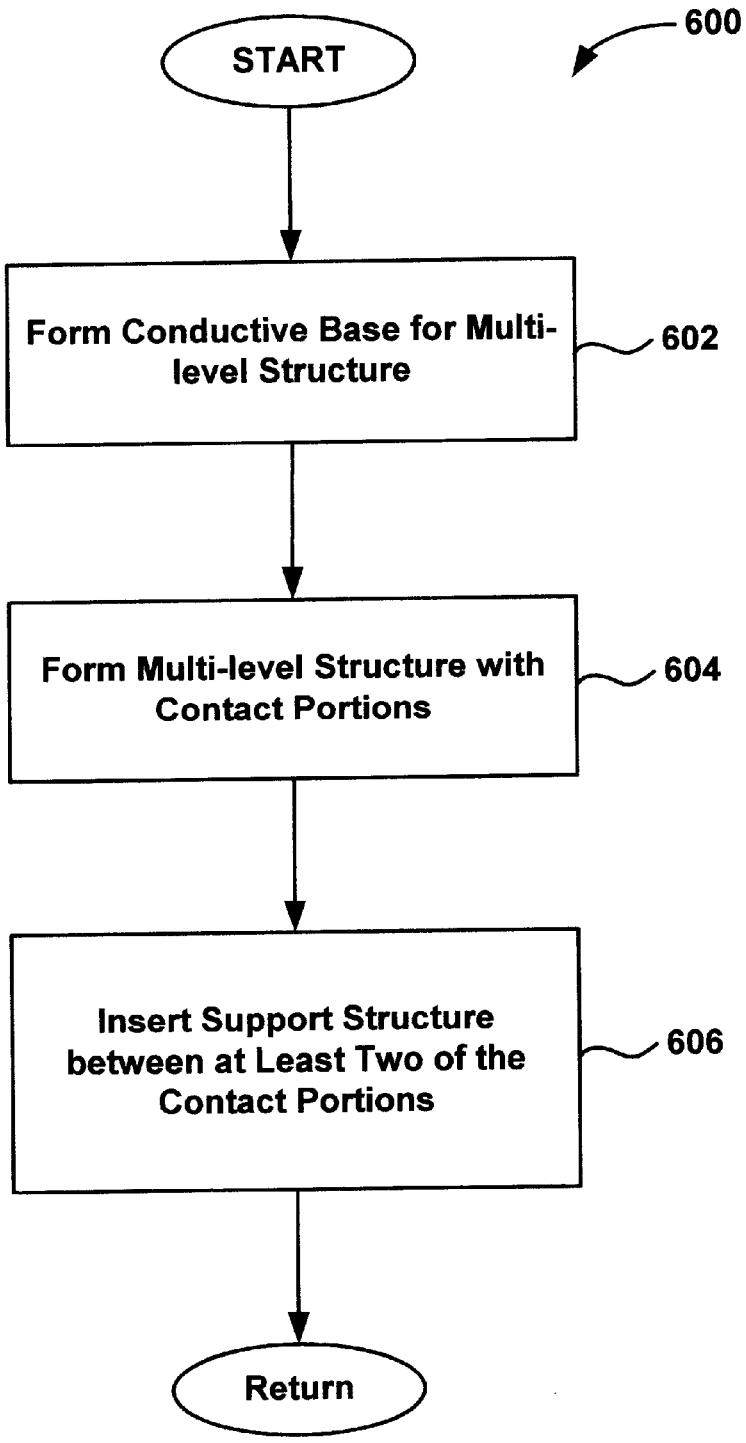
FIG. 6 is a flow chart of steps performed in accordance with another embodiment of the present claimed invention.

With reference now to FIG. 6, a flow chart 600 of steps performed in accordance with another embodiment of the present invention is shown. As recited in step 602, in this embodiment, prior to forming the multi-level matrix structure, the present invention forms a conductive base for the multi-level matrix structure. Specifically, the present embodiment patterns a thin film conductive guard band on the faceplate of the flat panel display (e.g. field emission display device). In this embodiment, the thin film conductive guard band is located where the first and second parallel ridges would normally contact the faceplate. In so doing, the present embodiment provides for good electrical connections between the wall edge material and to the aluminized coating which will be disposed over the phosphor (i.e. subpixel) regions. In one embodiment, the thin film conductive guard band is comprised of a base layer of black chrome to provide a black layer on the faceplate, followed by a layer of chrome. Once the thin film conductive guard band is formed, the multi-level matrix structure is formed over the thin film conductive guard band as recited in steps 604 and 606. Steps 604 and 606 are the same as steps 502 and 504, respectively, of FIG. 5, which are described in detail above, and which are not repeated here for purposes of brevity and clarity.

Thus, the present invention provides, in one embodiment, a black matrix structure which eliminates the need for precise positioning of the support structure. The present embodiment further provides a black matrix structure which alleviates the problems associated with maintaining the support structure in a precise location and orientation during subsequent manufacturing steps. The present embodiment further provides a black matrix structure which eliminates the need for large quantities of tedious and polluting adhesives to hold the support structure in place.

Figure 7A:
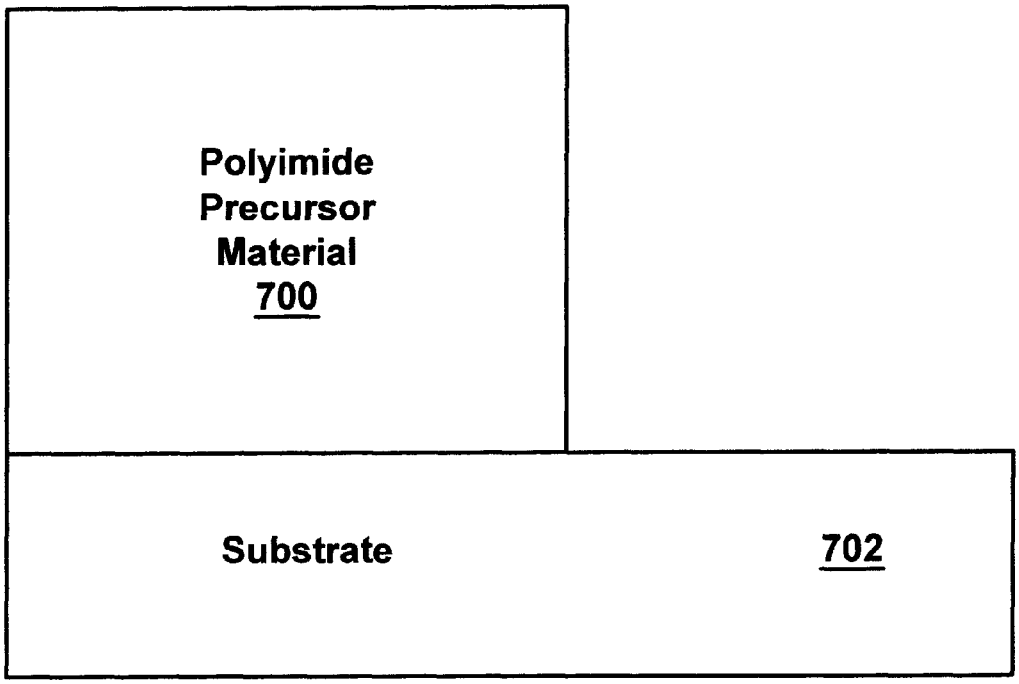
FIGS. 7A–7D are side sectional views of steps performed during the formation of a contact portion of a matrix structure in accordance with one embodiment of the present claimed invention.

With reference now to FIG. 7A, a side sectional view of a starting step performed during the formation of a contact portion is shown. This starting step is used to form the contact portion of a matrix structure wherein the contact portion is adapted to retain a support structure within a flat panel display device. As shown in FIG. 7A, the formation method of the present embodiment begins by disposing a polyimide precursor material 700 upon a substrate 702. In this embodiment, substrate 702 is comprised of a dimensionally stable material to which cured polyimide material is strongly adherent. In one embodiment, substrate 702 is comprised of chromium. In another embodiment, substrate 702 is silica. Although such materials are recited in specific embodiments, the present embodiment is well suited to the use of any dimensionally stable material to which cured polyimide material is strongly adherent. Furthermore, although the present embodiment specifically recites the use of a polyimide precursor material and the subsequent formation of cured polyimide, the present invention is well suited to use with other materials which display the features described below for the cured polyimide material, and which are compatible with the requirements for elements to be used in a flat panel display device.

Referring still to FIG. 7A, the present embodiment specifically deals with the formation of a contact portion of a matrix structure wherein the contact portion is adapted to retain a support structure within a flat panel display device. It will be understood, however, that the remaining portions of the matrix structure must also be formed. Although not specifically discussed in the present embodiment for purposes of clarity and brevity, remaining portions of the matrix structure can be formed, for example, using the methods disclosed, for example, in commonly-owned U.S. Pat. No. 5,858,619 to Chang et al., entitled "Multi-Level Conductive Matrix Formation Method", issued Jan. 12, 1999. The Chang et al. patent is incorporated herein as background material. Although such materials and formation methods are recited and incorporated by reference above, the present invention is also well suited to forming the remainder of the matrix structure the use of various other types of material and to being formed using any of various other available formation methods. Furthermore, the present embodiment is also well suited to forming the remainder of the matrix structure using similar methods to those described herein for forming a contact portion of a matrix structure wherein the contact portion is adapted to retain a support structure within a flat panel display device.

Figure 7B:
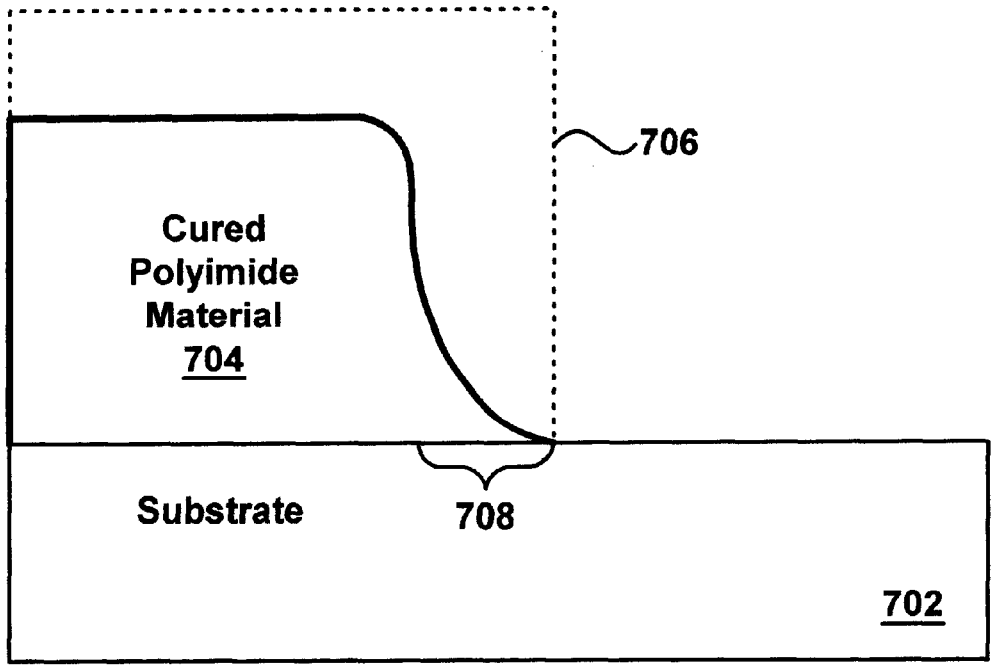

With reference now to FIG. 7B, the present embodiment then subjects polyimide precursor material 700 of FIG. 7A to a thermal imidization process. In so doing, the polyimide precursor material forms cured polyimide material 704. As shown in FIG. 7B, after the thermal imidization process shrinkage or retraction from the original boundary of polyimide precursor material 700 occurs. Specifically, dotted line 706 in FIG. 7B indicates the original location or boundary of polyimide precursor material 700 prior to the thermal imidization process. As indicated in FIG. 7B, cured polyimide material 704 has a significantly reduced size except for the region where cured polyimide material 704 contacts substrate 702. As a result, an extending region 708 of cured polyimide material 704 is formed proximate to substrate 702. Hence, for purposes of the present discussion, after the thermal imidization process, the regions of cured polyimide material 704 which are distant from substrate 702 are referred to as retracted regions, and the regions of cured polyimide material 704 which are proximate to substrate 702 are referred to as extending regions (e.g. region 708 of FIG. 7B).

Figure 7C:
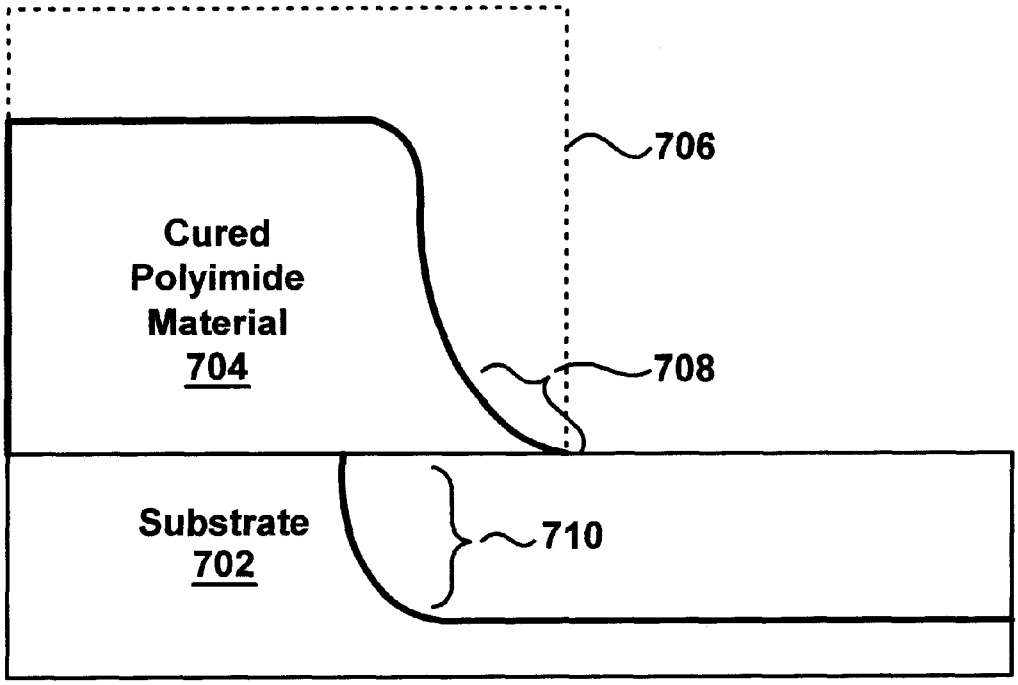

Referring now to FIG. 7C, after the thermal imidization process and consequent formation of extending region 708 of cured polyimide material 704, the present embodiment subjects substrate 702 to a selective etching process. Specifically, in the present embodiment, substrate 702 is selectively etched to undercut substrate 702 from beneath extending region 708 of cured polyimide material 704. That is, the present embodiment etches region 710 of substrate 702. In so doing, extending region 708 of cured polyimide material 704 is exposed and is, thus, formed to comprise the contact portion of a matrix structure.

Figure 7D:
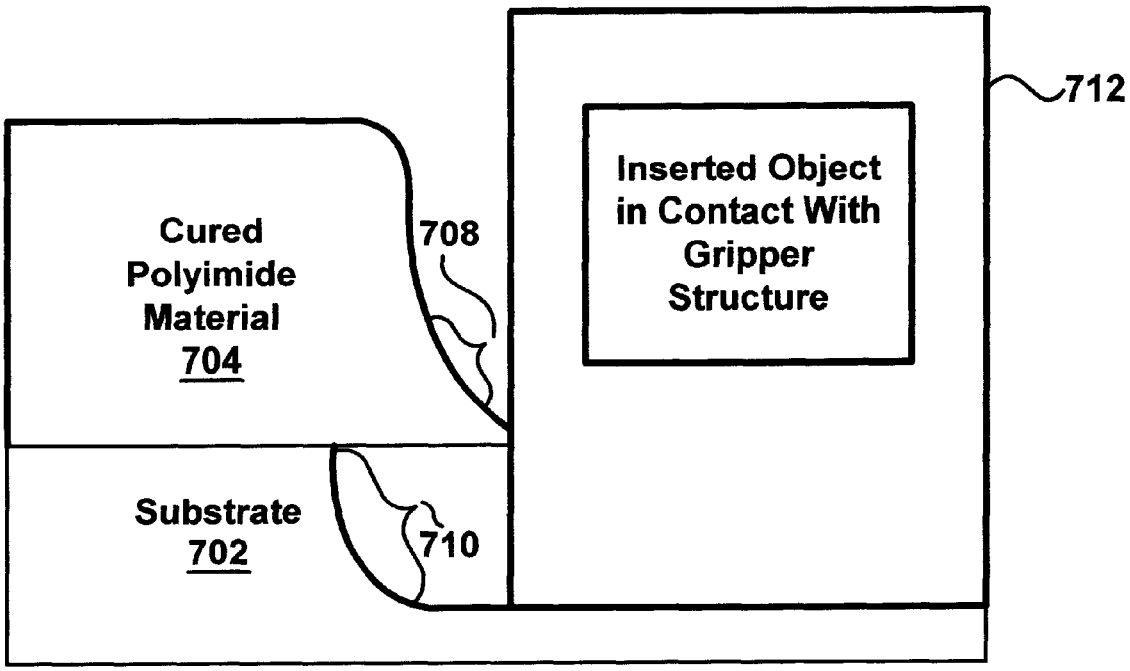

With reference now to FIG. 7D, a support structure 712 is shown being retained in a desired location and orientation by contact portion 708. Although not shown in FIG. 7D, it will be understood that other embodiments, a second contact portion (not shown) will be disposed opposing contact portion 708 such that support structure 712 is "sandwiched" and retained on two sides thereof by the opposing contact portions. In the embodiment of FIG. 7D, support structure 712 is shown as a wall type support structure. Although such a support structures is shown in the present embodiment, the present invention is also well suited to the use of various other types of support structures including, but not limited to, posts, crosses, pins, wall segments, T-shaped objects, and the like. Additionally, in one embodiment, the extending region of cured polyimide material is tailored to have a shape which corresponds to the shape of the support structure which will be retained by the contact portion. As an example, in one embodiment in which the support structure is comprised of a circular column, extending region 708 is formed having a recessed semicircular front surface. The recessed semicircular front surface of the contact portion will then peripherally surround at least a portion of the circular column and thereby retain the column shaped support structure in a desired location and orientation within the flat panel display device.

Figure 8:
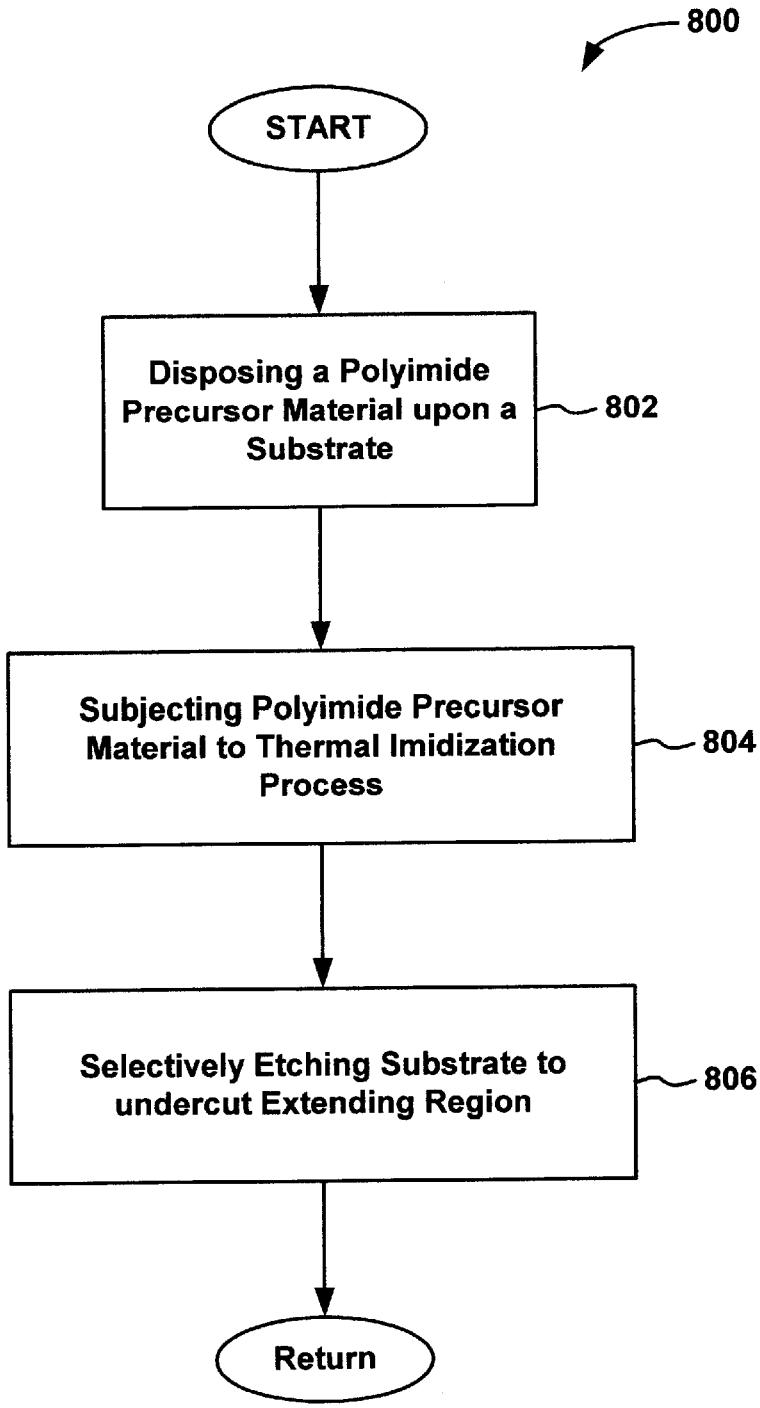
FIG. 8 is a flow chart of steps performed in accordance with another embodiment of the present claimed invention.

Referring now to FIG. 8, a flow chart 800 summarizing the steps recited in conjunction with the description of FIGS. 7A–7D is shown. As shown in step 802 of FIG. 8, the present embodiment first disposes a polyimide precursor material upon a substrate to which cured polyimide material is strongly adherent.

Next, at step 804, the present embodiment subjects the polyimide precursor material to a thermal imidization process. In so doing, an extending region of cured polyimide material is formed proximate to the substrate.

At step 806 of FIG. 8, the present embodiment selectively etches the substrate to undercut the substrate from beneath the extending region of the cured polyimide material. As a result, the extending region of cured polyimide material comprises the contact portion of a matrix structure and is adapted to retain a support structure within a flat panel display device.

Figure 9A:
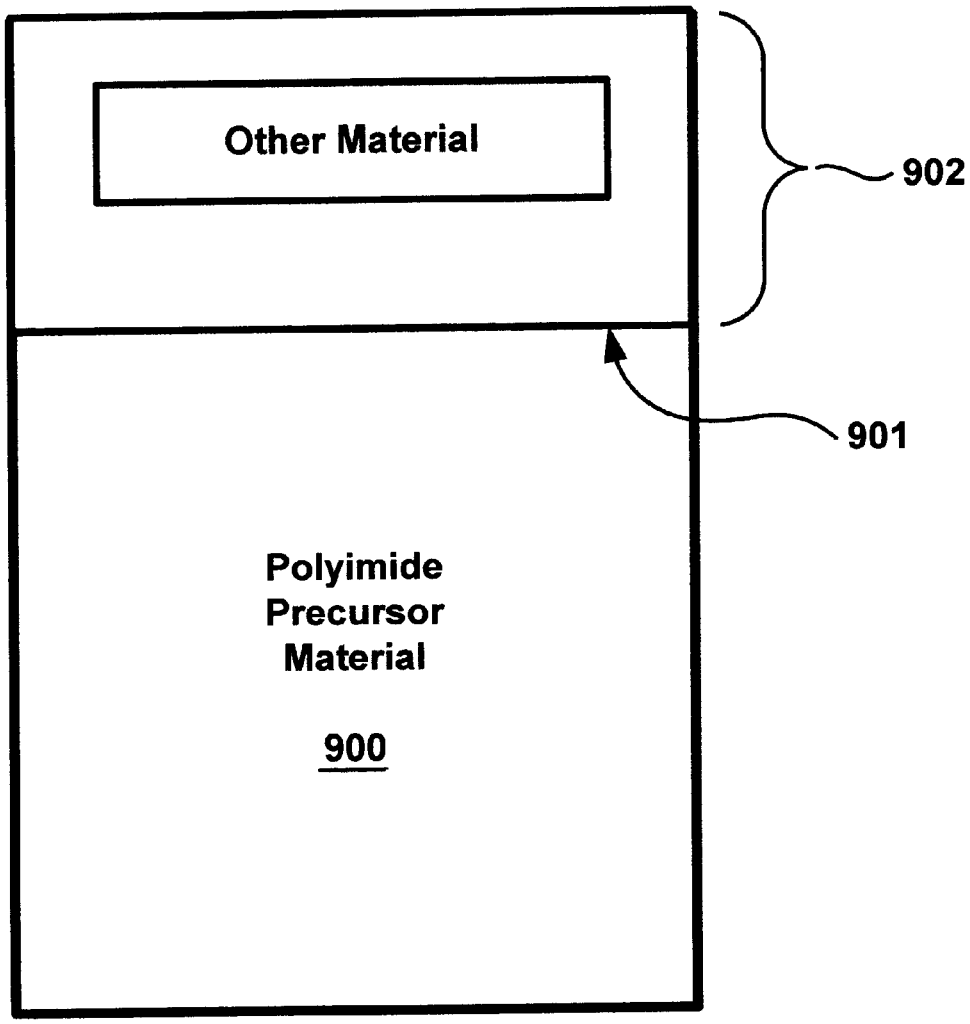
FIGS. 9A–9C are side sectional views of structures formed during the fabrication of a multi-layer heterostructure contact portion for a matrix structure in accordance with one embodiment of the present claimed invention.

With reference now to FIG. 9A, a side sectional view of a starting step performed during the formation of a contact portion is shown. This starting step is used to form the contact portion of a matrix structure wherein the contact portion is adapted to retain a support structure within a flat panel display device. As shown in FIG. 9A, the formation method of the present embodiment begins by disposing a polyimide precursor material 900 upon a first surface 901 of a first substrate 902. In this embodiment, substrate 902 is comprised of a dimensionally stable material to which cured polyimide material is strongly adherent. In one embodiment, substrate 902 is comprised of chromium. In another embodiment, substrate 902 is silica. Although such materials are recited in specific embodiments, the present embodiment is well suited to the use of any dimensionally stable material to which cured polyimide material is strongly adherent. Furthermore, although the present embodiment specifically recites the use of a polyimide precursor material and the subsequent formation of cured polyimide, the present invention is well suited to use with other materials which display the features described below for the cured polyimide material, and which are compatible with the requirements for elements to be used in a flat panel display device.

Referring still to FIG. 9A, the present embodiment specifically deals with the formation of a multi-layer heterostructure contact portion of a matrix structure wherein the multi-layer heterostructure contact portion is adapted to retain a support structure within a flat panel display device. It will be understood, however, that the remaining portions of the matrix structure must also be formed. Although not specifically discussed in the present embodiment for purposes of clarity and brevity, remaining portions of the matrix structure can be formed, for example, using the methods disclosed, for example, in commonly-owned U.S. Pat. No. 5,858,619 to Chang et al., entitled "Multi-Level Conductive Matrix Formation Method", issued Jan. 12, 1999. The Chang et al. patent is incorporated herein as background material. Although such materials and formation methods are recited and incorporated by reference above, the present invention is also well suited to forming the remainder of the matrix structure the use of various other types of material and to being formed using any of various other available formation methods. Furthermore, the present embodiment is also well suited to forming the remainder of the matrix structure using similar methods to those described herein for forming a contact portion of a matrix structure wherein the contact portion is adapted to retain a support structure within a flat panel display device.

Figure 9B:
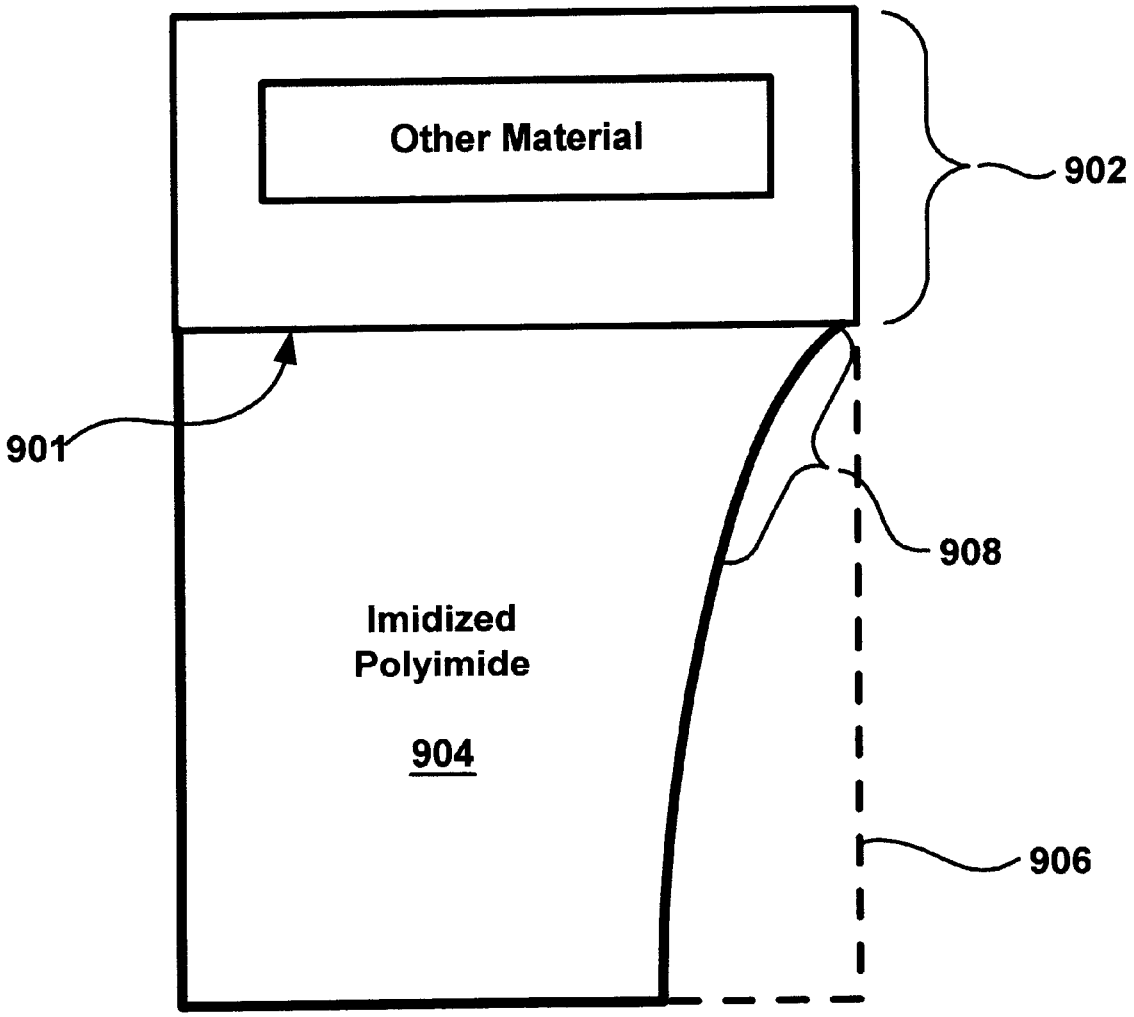

With reference now to FIG. 9B, the present embodiment then subjects polyimide precursor material 900 of FIG. 9A to a thermal imidization process. In so doing, the polyimide precursor material forms cured or "imidized" polyimide material 904. As shown in FIG. 9B, after the thermal imidization process shrinkage or retraction from the original boundary of polyimide precursor material 900 occurs. Specifically, dotted line 906 in FIG. 9B indicates the original location or boundary of polyimide precursor material 900 prior to the thermal imidization process. As indicated in FIG. 9B, cured polyimide material 904 has a significantly reduced size except for the region where cured polyimide material 904 contacts first surface 901 of substrate 902. As a result, an extending region 908 of cured polyimide material 904 is formed proximate to first surface 901 of substrate 902. Hence, for purposes of the present discussion, after the thermal imidization process, the regions of cured polyimide material 904 which are distant from first surface 901 of substrate 902 are referred to as retracted regions, and the regions of cured polyimide material 904 which are proximate to first surface 901 of substrate 902 are referred to as extending regions (e.g. region 908 of FIG. 9B).

Figure 9C:
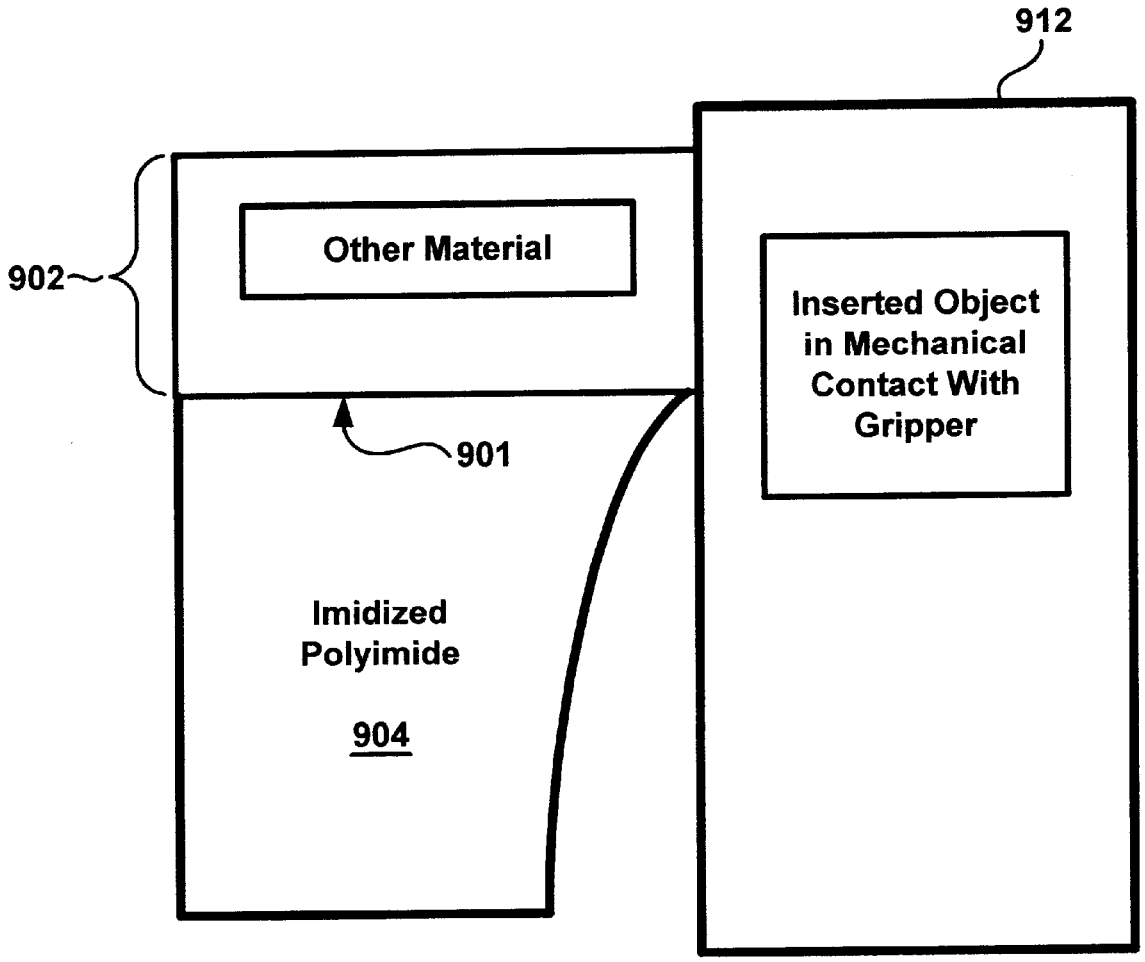

With reference now to FIG. 9C, a support structure 912 is shown being retained in a desired location and orientation by substrate 902 which comprises the contact portion in the present embodiment. Although not shown in FIG. 9C, it will be understood that in other embodiments, a second contact portion (not shown) will be disposed opposing the first contact portion (i.e. that portion of substrate 902 which contacts support structure 912) such that support structure 912 is "sandwiched" and retained on two sides thereof by the opposing contact portions. In the embodiment of FIG. 9C, support structure 912 is shown as a wall type support structure. Although such a support structures is shown in the present embodiment, the present invention is also well suited to the use of various other types of support structures including, but not limited to, posts, crosses, pins, wall segments, T-shaped objects, and the like. Additionally, in one embodiment, the portion of substrate 902 which contacts support structure 912 is tailored to have a shape which corresponds to the shape of the support structure which will be retained by the portion of substrate 902 which contacts support structure 912. As an example, in one embodiment in which the support structure is comprised of a circular column, the portion of substrate 902 which contacts support structure 912 is formed having a recessed semicircular front surface. The recessed semicircular front surface of the portion of substrate 902 which contacts support structure 912 will then peripherally surround at least a portion of the circular column and thereby retain the column shaped support structure in a desired location and orientation within the flat panel display device.

Figure 10:
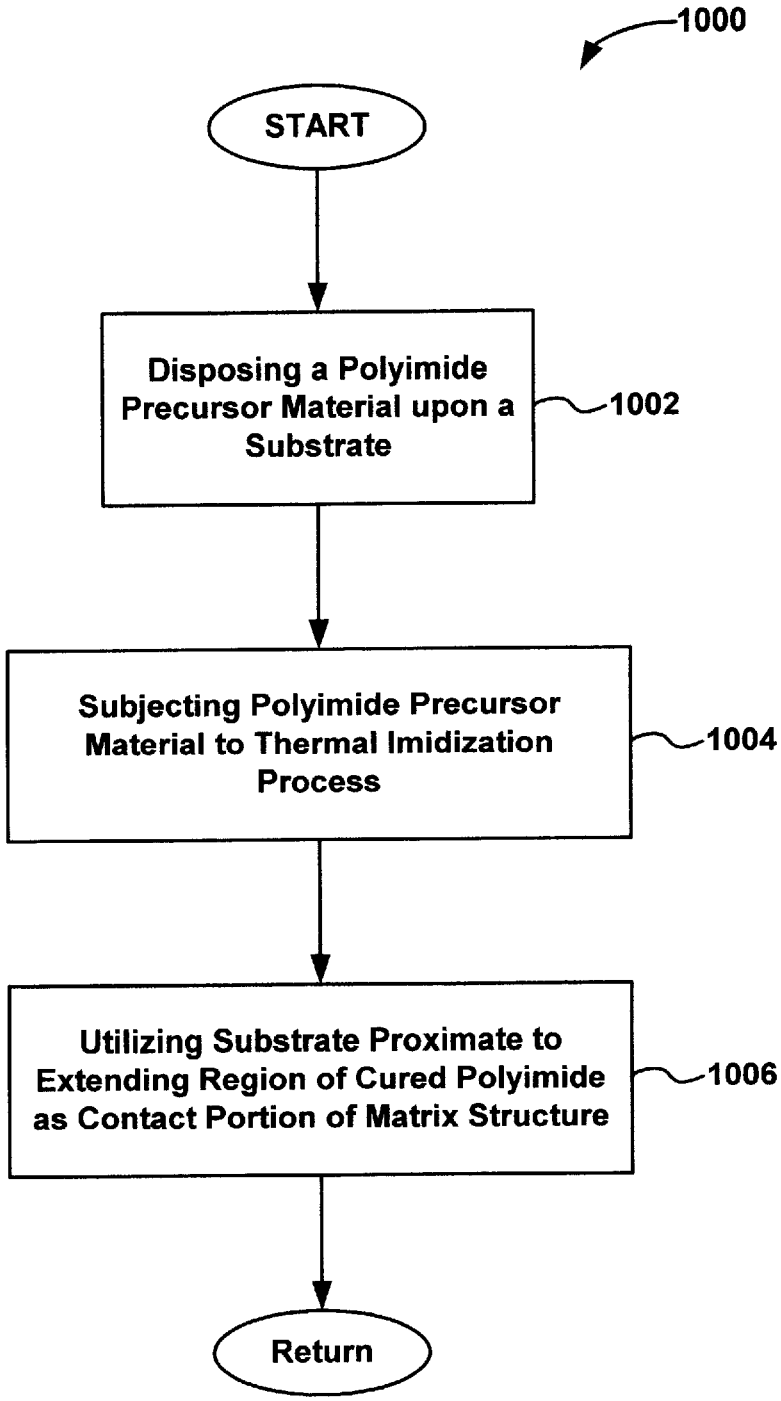
FIG. 10 is a flow chart of steps performed in accordance with another embodiment of the present claimed invention.

Referring now to FIG. 10, a flow chart 1000 summarizing the steps recited in conjunction with the description of FIGS. 9A–9C is shown. As shown in step 1002 of FIG. 10, the present embodiment first disposes a polyimide precursor material upon a substrate to which cured polyimide material is strongly adherent.

Next, at step 1004, the present embodiment subjects the polyimide precursor material to a thermal imidization process. In so doing, an extending region of cured polyimide material is formed proximate to the substrate.

Next, at step 1006, the present embodiment utilizes that portion of the substrate which is proximate to the extending region of cured polyimide material as the contact portion of the matrix structure.

Figure 11A:
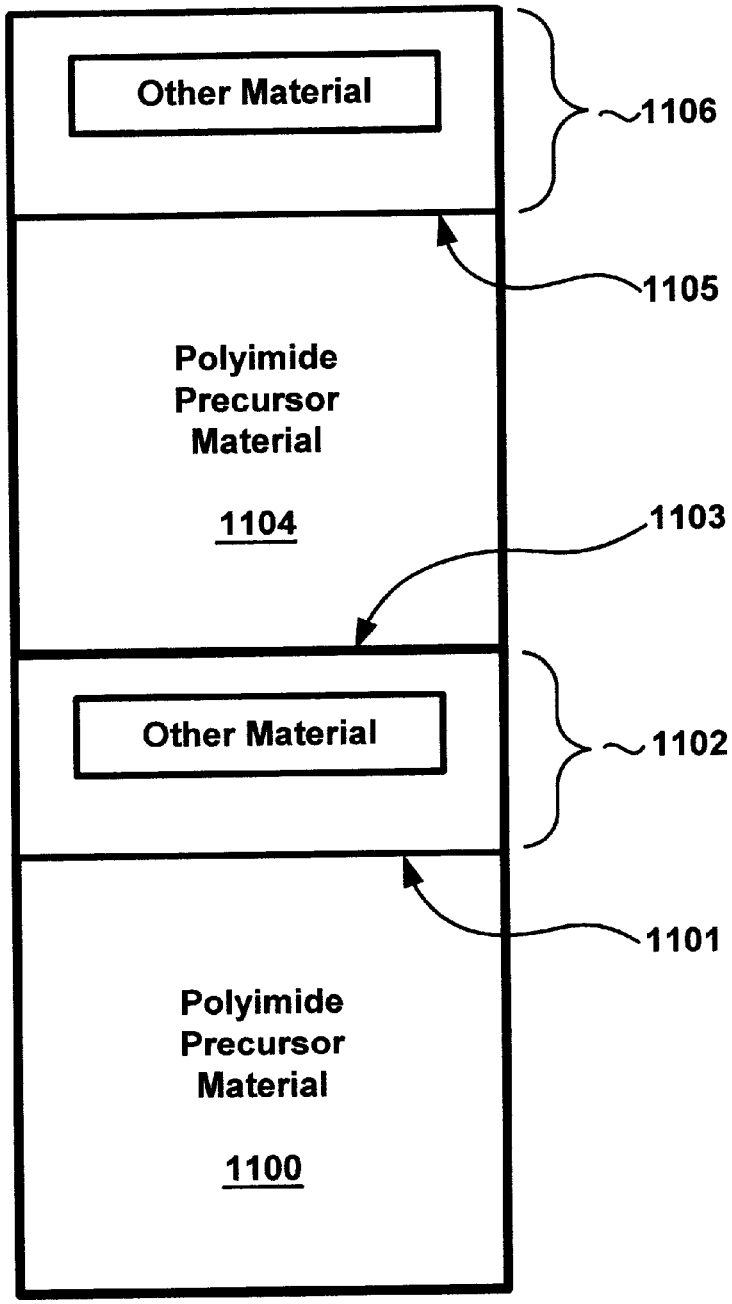
FIGS. 11A–11C are side sectional views of structures formed during the fabrication of a stacked multi-layer heterostructure contact portion for a matrix structure in accordance with one embodiment of the present claimed invention.

With reference now to FIG. 11A, a side sectional view of a starting step performed during the formation of a multi-layer heterostructure contact portion is shown. This starting step is used to form the multi-layer heterostructure contact portion of a matrix structure wherein the contact portion is adapted to retain a support structure within a flat panel display device. As shown in FIG. 11A, the formation method of the present embodiment begins by disposing a polyimide precursor material 1100 upon a first surface 1101 of a first substrate 1102. In this embodiment, substrate 1102 is comprised of a dimensionally stable material to which cured polyimide material is strongly adherent. Although not shown, another substrate will be disposed at the base of polyimide precursor material 1100. In one embodiment, substrate 1102 is comprised of chromium. In another embodiment, substrate 1102 is silica. Additionally in the present embodiment, the formation method of the present embodiment disposes a second polyimide precursor material 1104 between a second surface 1103 of first substrate 1102 and a first surface 1105 of a second substrate 1106. Furthermore, the present embodiment is well suited to disposing polyimide precursor material 1100 and 1104 either sequentially (i.e. one after the other) or concurrently (i.e. at approximately the same time.

Referring still to FIG. 11A, in this embodiment, substrates 1102 and 1106 are comprised of a dimensionally stable material to which cured polyimide material is strongly adherent. In one embodiment, substrate 1102 is comprised of chromium. In another embodiment, substrate 1102 is silica. Also, in one embodiment, substrate 1106 is comprised of chromium. In another embodiment, substrate 1106 is comprised of silica. Although such materials are recited in specific embodiments, the present embodiment is well suited to the use of any dimensionally stable material to which cured polyimide material is strongly adherent.

Although the present embodiment specifically recites the use of a polyimide precursor material and the subsequent formation of cured polyimide, the present invention is well suited to use with other materials which display the features described below for the cured polyimide material, and which are compatible with the requirements for elements to be used in a flat panel display device.

Referring still to FIG. 11A, the present embodiment specifically deals with the formation of a multi-layer heterostructure contact portion of a matrix structure wherein the multi-layer heterostructure contact portion is adapted to retain a support structure within a flat panel display device. It will be understood, however, that the remaining portions of the matrix structure must also be formed. Although not specifically discussed in the present embodiment for purposes of clarity and brevity, remaining portions of the matrix structure can be formed, for example, using the methods disclosed, for example, in commonly-owned U.S. Pat. No. 5,858,619 to Chang et al., entitled "Multi-Level Conductive Matrix Formation Method", issued Jan. 12, 1999. The Chang et al. patent is incorporated herein as background material. Although such materials and formation methods are recited and incorporated by reference above, the present invention is also well suited to forming the remainder of the matrix structure the use of various other types of material and to being formed using any of various other available formation methods. Furthermore, the present embodiment is also well suited to forming the remainder of the matrix structure using similar methods to those described herein for forming a contact portion of a matrix structure wherein the contact portion is adapted to retain a support structure within a flat panel display device.

Figure 11B:
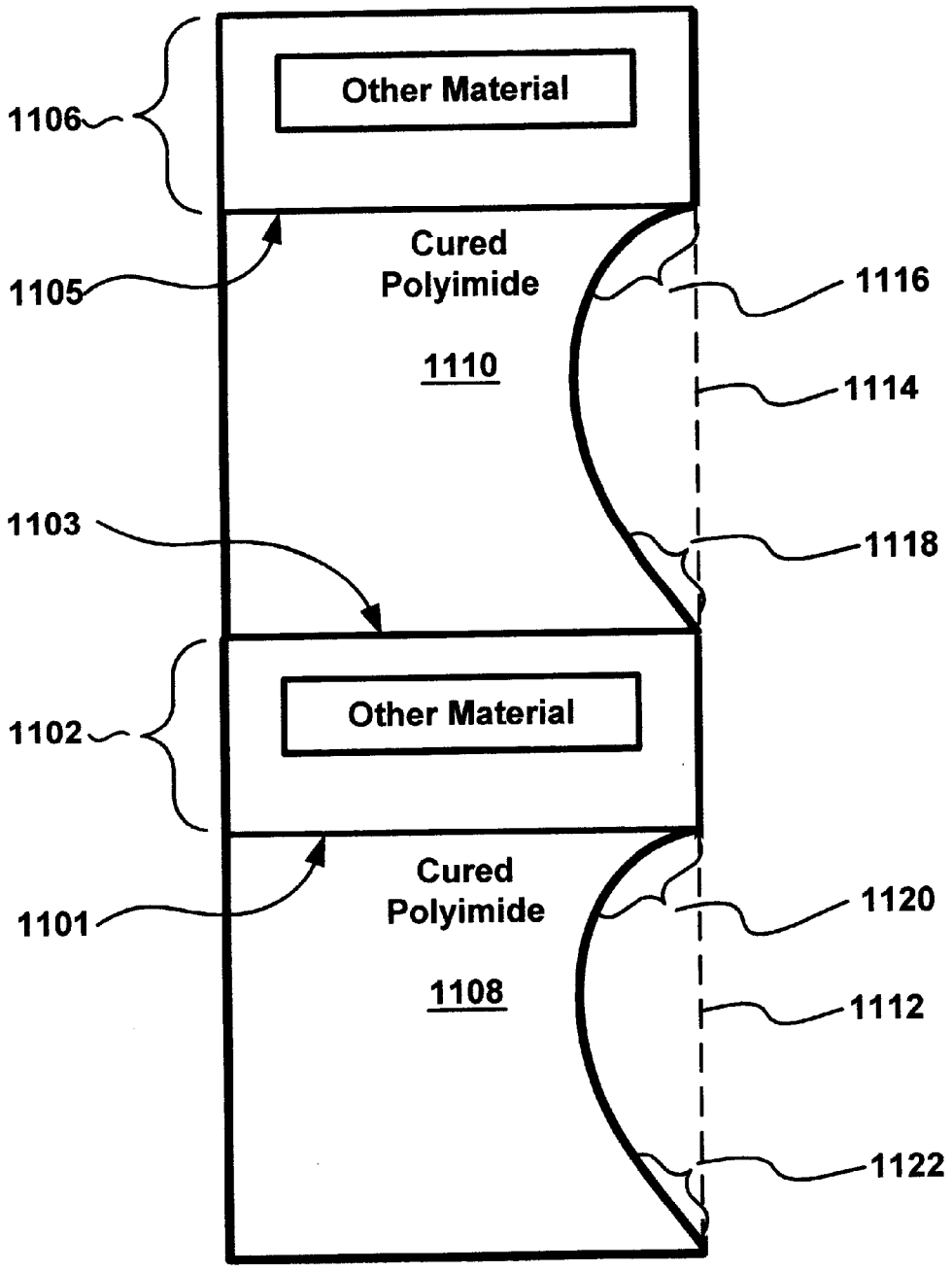

With reference now to FIG. 11B, the present embodiment then subjects polyimide precursor material 1100 and polyimide precursor material 1104, both of FIG. 11A, to a thermal imidization process. In so doing, the polyimide precursor material forms cured or "imidized" polyimide material 1108 and 1110. As shown in FIG. 11B, after the thermal imidization process shrinkage or retraction from the original boundary of polyimide precursor material 1100 and 1104 occurs. Specifically, dotted lines 1112 and 1114 in FIG. 11B indicate the original location or boundary of polyimide precursor materials 1100 and 1104, respectively, prior to the thermal imidization process. As indicated in FIG. 11B, cured polyimide material 1108 and 1110 have a significantly reduced size except for the region where cured polyimide material contacts first surface 1101 of first substrate 1102, second surface 1103 of first substrate 1102, and first surface 1105 of second substrate 1106. As a result, extending regions 1116 and 1118 of cured polyimide material 1110 are formed proximate to first surface 1105 of second substrate 1106 and second surface 1103 of first substrate 1102, respectively. Similarly, extending regions 1120 and 1122 of cured polyimide material 1108 are formed proximate to first surface 1101 of first substrate 1102 and the substrate, not shown located beneath cured polyimide material 1108, respectively. Hence, for purposes of the present discussion, after the thermal imidization process, the regions of cured polyimide material 1108 and 1110 which are distant from the base (not shown), first substrate 1102, and second substrate 1106 are referred to as retracted regions, and the regions of cured polyimide material 1108 and 1110 which are proximate to the base (not shown), first substrate 1102, and second substrate 1106 are referred to as extending regions (e.g. regions 1116, 1118, 1120, and 1122 of FIG. 11B).

Figure 11C:
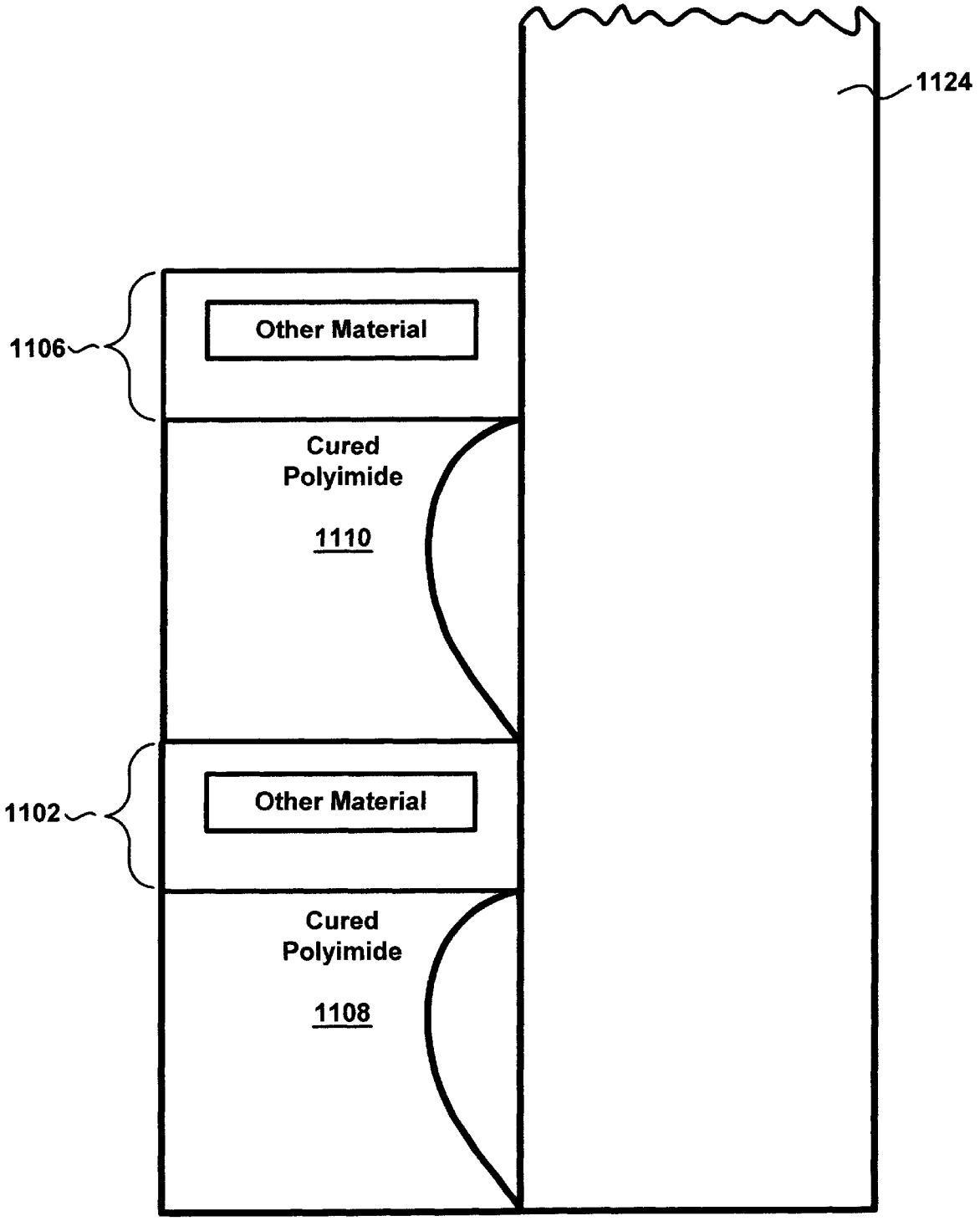

With reference now to FIG. 11C, a support structure 1124 is shown being retained in a desired location and orientation by first substrate 1102 and second substrate 1106 which comprise the contact portion in the present embodiment. Although not shown in FIG. 11C, it will be understood that other in embodiments, a second contact portion (not shown) will be disposed opposing the first contact portion (i.e. that portion of first substrate 1102 and second substrate 1106 which contact support structure 1124) such that support structure 1124 is "sandwiched" and retained on two sides thereof by the opposing contact portions. In the embodiment of FIG. 11C, support structure 1124 is shown as a wall type support structure. Although such a support structures is shown in the present embodiment, the present invention is also well suited to the use of various other types of support structures including, but not limited to, posts, crosses, pins, wall segments, T-shaped objects, and the like. Additionally, in one embodiment, the portion of first substrate 1102 and second substrate 1106 which contact support structure 1124 are tailored to have a shape which corresponds to the shape of the support structure which will be retained by the portion of first substrate 1102 and second substrate 1106 which contact support structure 1124. As an example, in one embodiment in which the support structure is comprised of a circular column, the portion of first substrate 1102 and second substrate 1106 which contact support structure 1124 is formed having a recessed semicircular front surface. The recessed semicircular front surface of the portion of first substrate 1102 and second substrate 1106 which contact support structure 1124 will then peripherally surround at least a portion of the circular column and thereby retain the column shaped support structure in a desired location and orientation within the flat panel display device.

Also, although the above-described embodiment recites forming cured polyimide 1108 and 1110 at the same time, the present invention is also well suited to an embodiment in which a first cured polyimide portion is formed (e.g. cured polyimide material 1108), and then a second cured polyimide portion (e.g. cured polyimide material 1110) is formed on the first cured polyimide portion. Furthermore, the present invention is also well suited to an embodiment in which more than two layers of cured polyimide material are formed sequentially or currently.

Thus, the present invention provides, in one embodiment, a black matrix structure formation method which eliminates the need for precise positioning of the support structure. The present embodiment further provides a black matrix structure formation method which alleviates the problems associated with maintaining the support structure in a precise location and orientation during subsequent manufacturing steps. The present invention also provides, in one embodiment, black matrix structure formation method which eliminates the need for large quantities of tedious and polluting adhesives to hold the support structure in place.

Figure 12A:
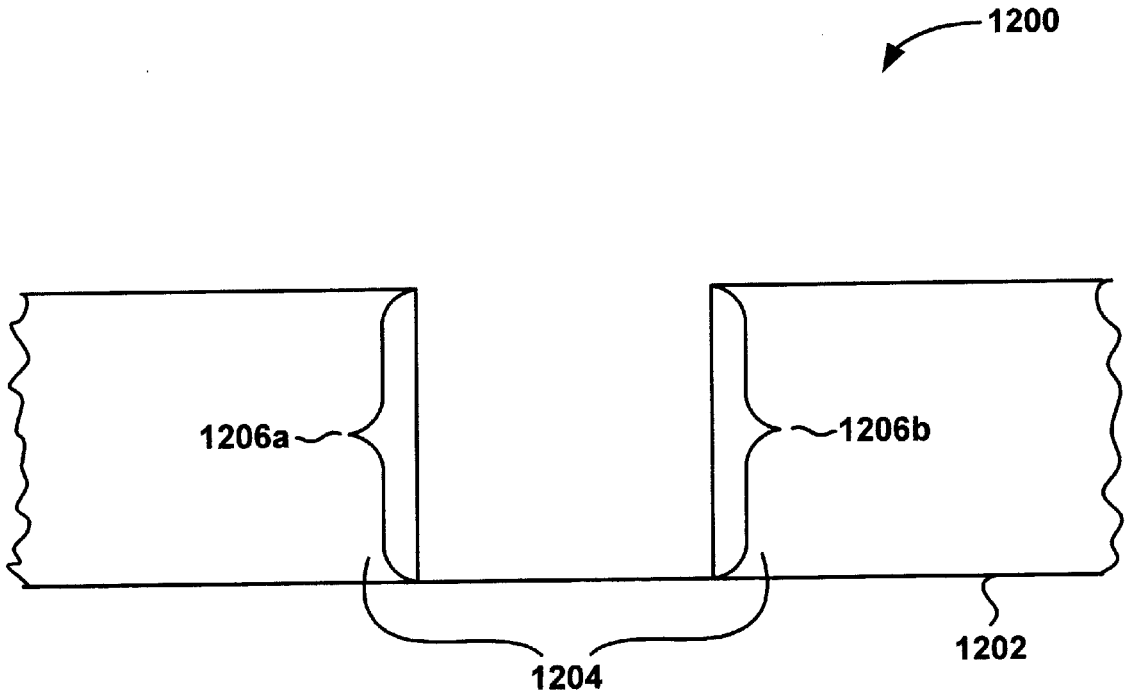
FIGS. 12A–12J are side sectional views of structures formed during the fabrication of an electrically robust matrix structure including a contact portion for retaining a support structure within a flat panel display device in accordance with one embodiment of the present claimed invention.

With reference now to FIG. 12A, a side sectional view of a starting step performed during the formation of an electrically robust multi-layer matrix structure 1200 wherein electrically robust multi-layer matrix structure 1200 includes a contact portion adapted to retain a support structure within a flat panel display device is shown. The contact portion of electrically robust multi-layer matrix structure 1200 will be the same as, and will exhibit the same features and possess the same advantages as, the contact portions described in detail in the above-listed embodiments. For purposes of clarity in the following discussion, the second plurality of parallel spaced apart conductive ridges, typically shown as 1204, are shown formed on surface 1202 prior to the formation of the first plurality of substantially parallel spaced apart conductive ridges. Although the first plurality of substantially parallel spaced apart conductive ridges are formed after the formation of second parallel ridges 1204 in this embodiment, the present invention is also well suited to an embodiment in which second parallel ridges 1204 are formed after the formation of the first plurality of substantially parallel spaced apart conductive ridges, and to an embodiment in which the first plurality of substantially parallel spaced apart conductive ridges are formed concurrently with the formation of second parallel ridges 1204.

With reference still to FIG. 12A, matrix structure formation methods are disclosed, for example, in commonly-owned U.S. Pat. No. 5,858,619 to Chang et al., entitled "Multi-Level Conductive Matrix Formation Method", issued Jan. 12, 1999. The Chang et al. patent is incorporated herein as background material. As mentioned above, however, the Chang et al. reference does not address the formation of a multi-layer matrix structure having contact portions for retaining a support structure at a desired location within a flat panel display device. Moreover, the Chang et al. reference does not address the formation of an electrically robust multi-layer matrix structure having contact portions for retaining a support structure at a desired location within a flat panel display device. Also, it will be understood that in the present embodiment, second parallel ridges 1204 are oriented substantially orthogonally with respect to the first plurality of substantially parallel spaced apart conductive ridges. In the present embodiment, second parallel ridges 1204 have a height which is greater than the height of the first plurality of substantially parallel spaced apart conductive ridges. Additionally, the second plurality of parallel spaced apart ridges include contact portions 1206*a* and 1206*b* for retaining a support structure at a desired location within the flat panel display device. A detailed description of the structure and function of contact portions 1206*a* and 1206*b* is given above in conjunction with the description of FIGS. 1–6.

Referring again to FIG. 12A, in the present embodiment, the first plurality of substantially parallel spaced apart conductive ridges comprise rows of electrically robust multi-layer matrix structure 1200. However, the present invention is also well suited to an embodiment in which the first plurality of substantially parallel spaced apart conductive ridges comprise columns of electrically robust multi-layer matrix structure 1200.

Also, in the present embodiment surface 1202 is a faceplate of a flat panel display device. However, the present embodiment is also well suited to an embodiment in which surface 1202 is a cathode of a flat panel display device. In such an embodiment (in which surface 1202 is a cathode of a flat panel display device), it is understood that phosphor regions and subpixels will not be formed between the first plurality of substantially parallel spaced apart conductive ridges and the second parallel ridges.

Figure 12B:
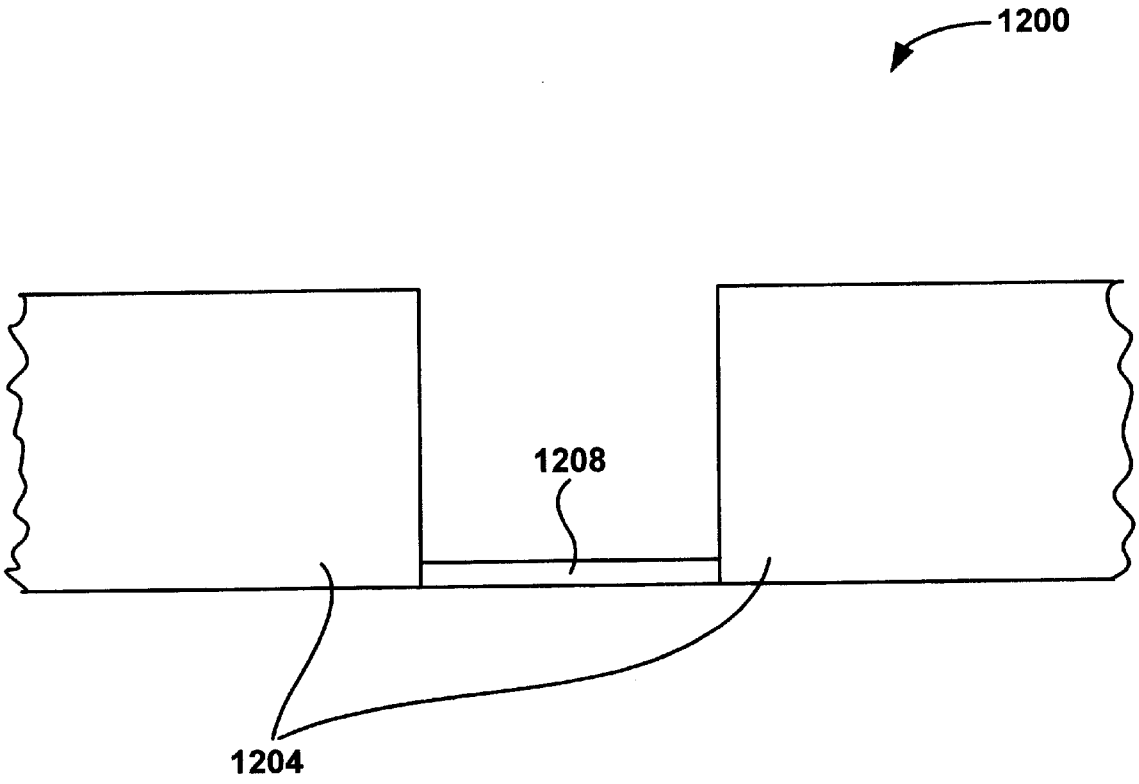

With reference now to FIG. 12B, a side sectional view of an initial step in the formation of a first plurality of substantially parallel spaced apart conductive ridges for electrically robust multi-layer matrix structure 1200 is shown. In the present embodiment, the first plurality of substantially parallel spaced apart conductive ridges are formed of multiple layers. Specifically, in this embodiment, a layer of black chrome 1208 is deposited to form the base of the first plurality of substantially parallel spaced apart conductive ridges. Although black chrome is used in the present embodiment, the present invention is well suited to the use of various other opaque materials as the base of the first plurality of substantially parallel spaced apart conductive ridges.

Figure 12C:
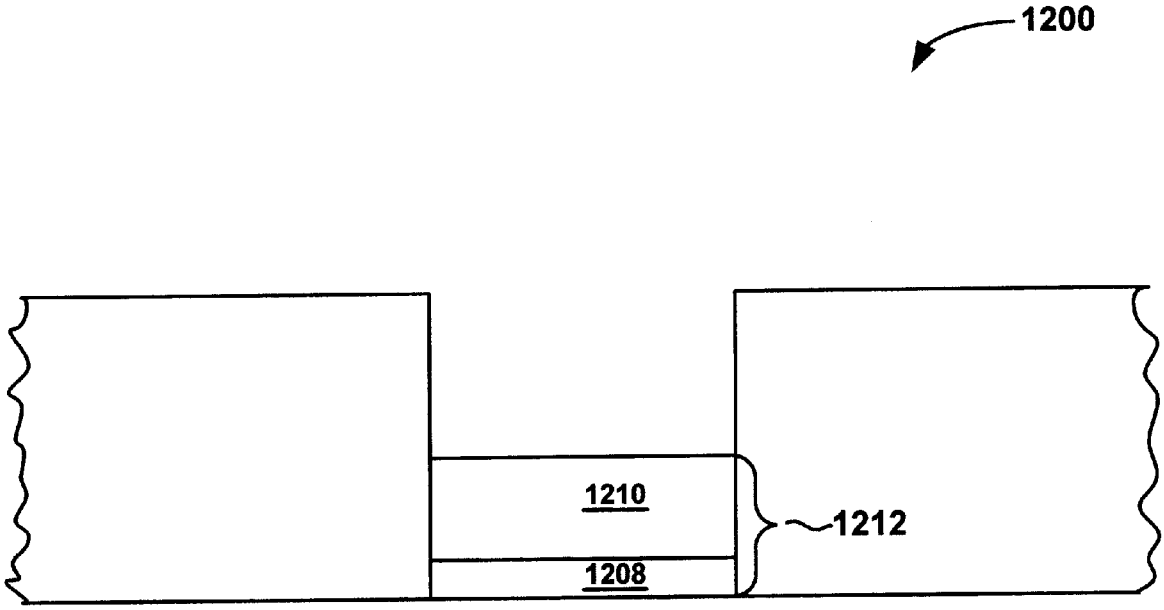

With reference next to FIG. 12C, a side sectional view of another step in the formation of a first plurality of substantially parallel spaced apart conductive ridges for electrically robust multi-layer matrix structure 1200 is shown. In this embodiment, a layer of conductive material 1210 is deposited above layer of black chrome 1208 to complete the initial formation of the first plurality of substantially parallel spaced apart conductive ridges. In the present embodiment, conductive material 1210 deposited above layer of black chrome 1208 is chrome. Although chrome is used in the present embodiment, the present invention is well suited to the use of various other conductive materials (which are suited to use within a flat panel display device) as the body of the first plurality of substantially parallel spaced apart conductive ridges.

Figure 12D:
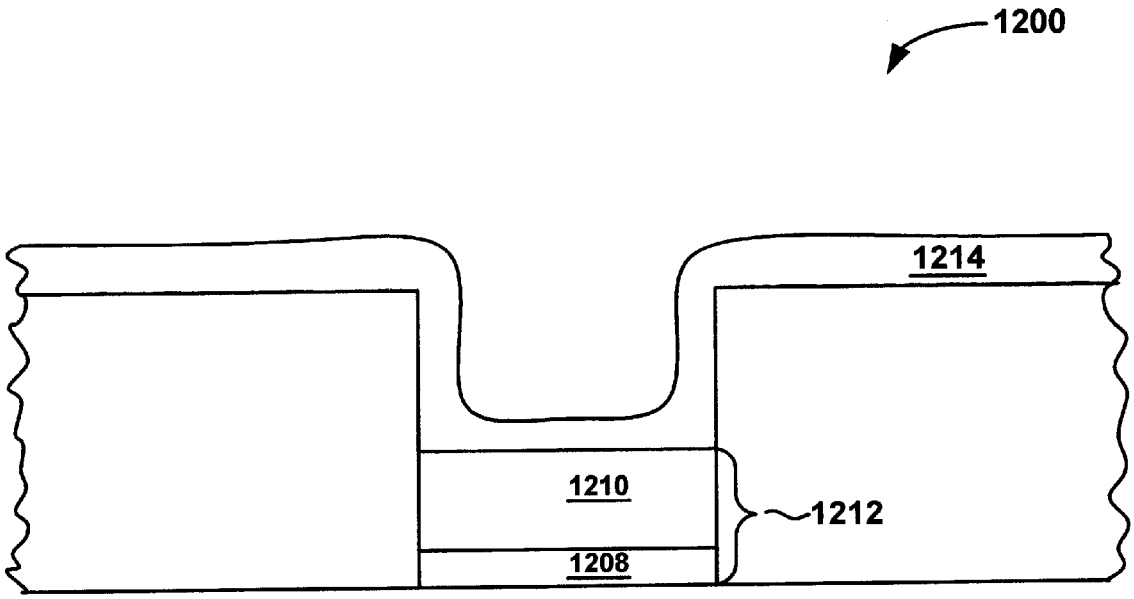

Referring now to FIG. 12D, upon the completion of the formation of the base 1208 and body 1210 of first plurality of substantially parallel spaced apart conductive ridges 1212, the present embodiment applies a dielectric material 1214 to first plurality of substantially parallel spaced apart conductive ridges 1212. In the present embodiment, dielectric material 1214 is comprised of silicon dioxide. Although such a material is recited in the present embodiment, the present invention is also well suited to the use of various other dielectric materials.

Figure 12E:
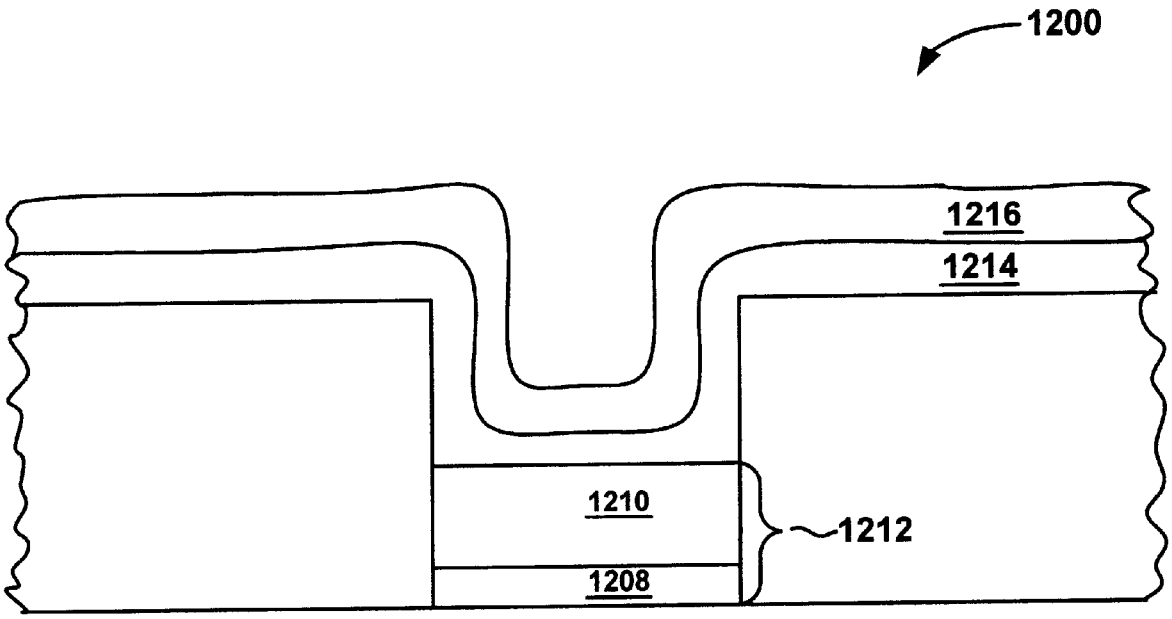

With reference next to FIG. 12E, upon the deposition of dielectric material 1216, the present embodiment deposits layer of photo-imagable material 1216 (e.g. photoresist) above dielectric material 1214.

Figure 12F:
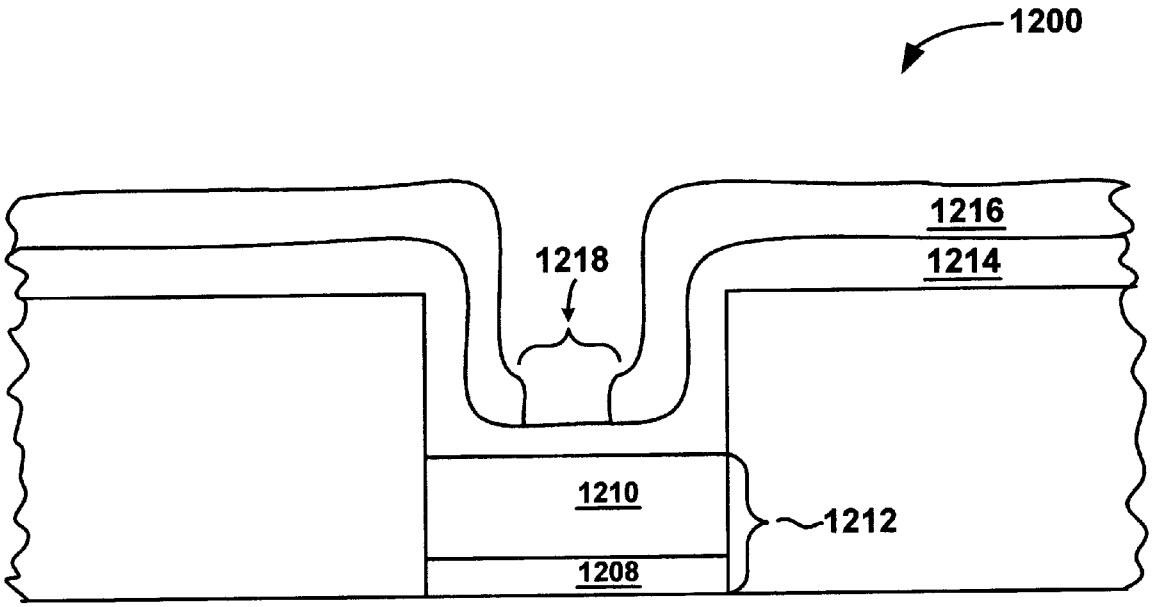

With reference now to FIG. 12F, upon the deposition of layer of photo-imagable material 1216, layer of photo-imagable material 1216 is patterned to form an opening 1218. Opening 1218 exposes a portion of dielectric material 1214.

Figure 12G:
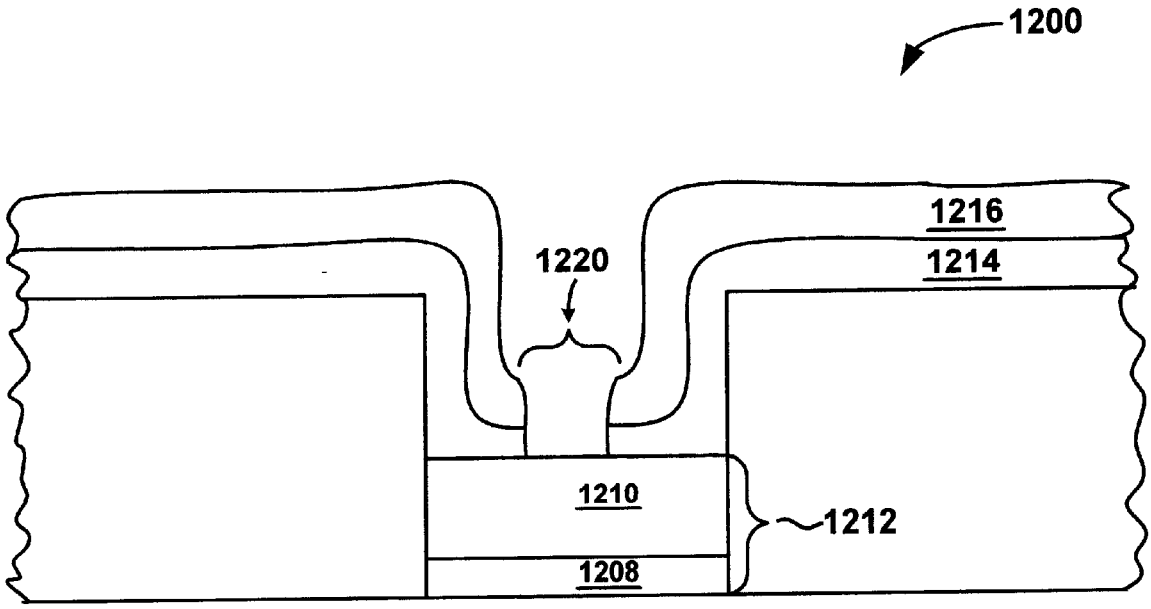

Referring now to FIG. 12G, the present embodiment then subjects the exposed portion of dielectric material 1214 to a dielectric etch process. In so doing, the exposed portion of dielectric material 1214 is removed to form an opening 1220. As shown in FIG. 12G, opening 1220 extends through photo-imagable material 1216 and dielectric material 1214. As a result, an exposed region at the top surface of first plurality of substantially parallel spaced apart conductive ridges 1212 is generated.

Figure 12H:
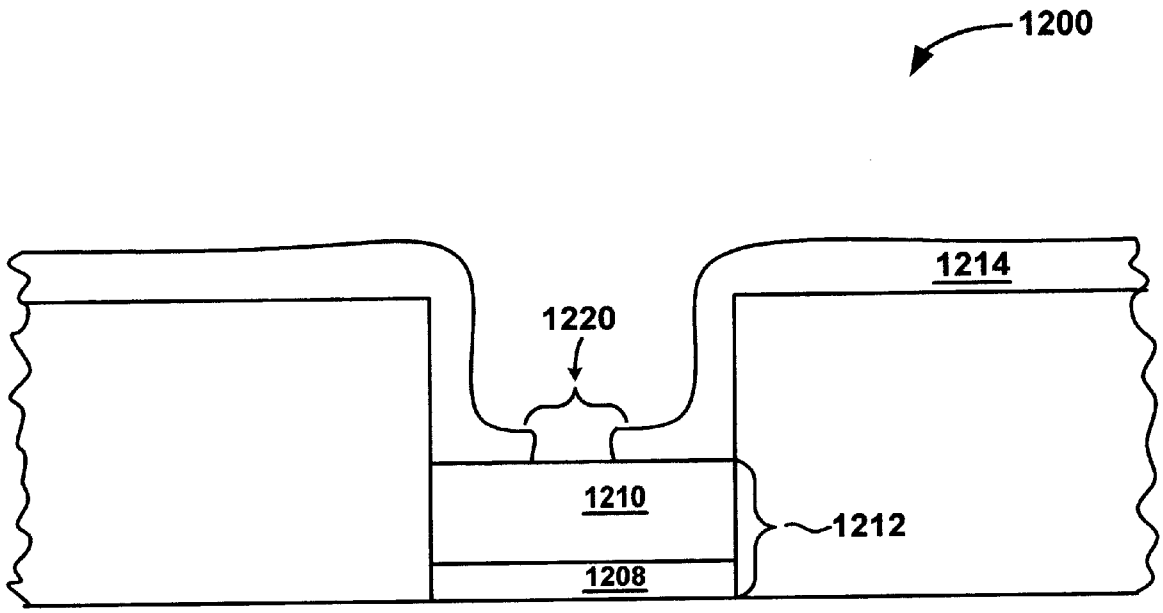

With reference now to FIG. 12H, the present embodiment then removes the remaining portion of layer of photo-imagable material 1216.

Figure 12I:
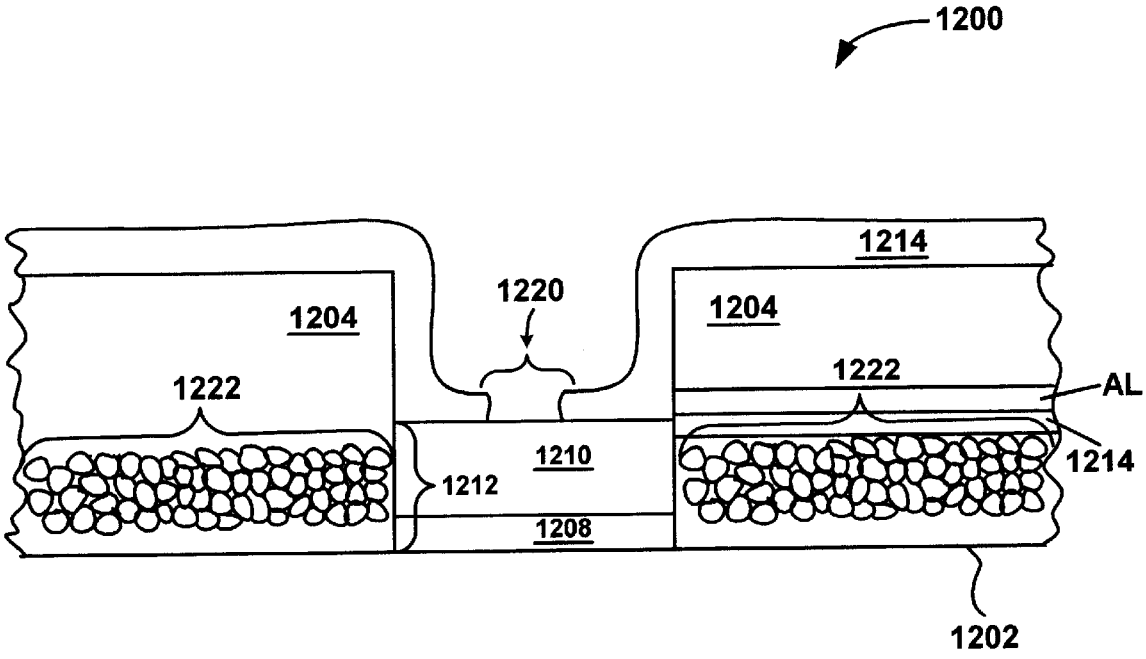
Figure 12J:
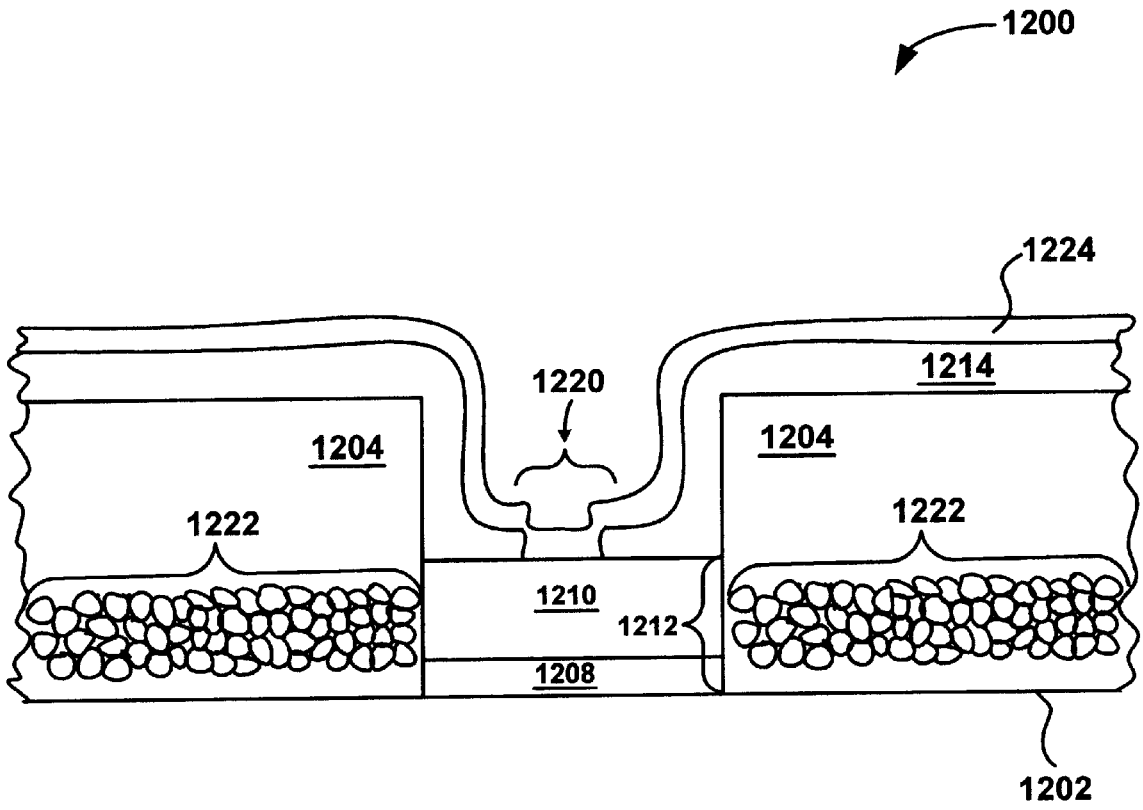

Referring now to FIG. 12I, in an embodiment in which surface 1202 is a faceplate of a flat panel display device, phosphor regions and subpixels 1222 are formed between first plurality of substantially parallel spaced apart conductive ridges 1212 and the second parallel ridges 1204 above surface 1202. As mentioned above, in an embodiment in which surface 1202 is a cathode of a flat panel display device, phosphor regions and subpixels will not be formed between first plurality of substantially parallel spaced apart conductive ridges 1212 and second parallel ridges 1204.

With reference now to FIG. 12E, the present embodiment then deposits a layer of conductive material 1224 over first plurality of substantially parallel spaced apart conductive ridges 1212. In so doing, layer of conductive material 1224 is electrically coupled to the exposed region of first plurality of substantially parallel spaced apart conductive ridges 1212 at opening 1220. In one embodiment, layer of conductive material 1224 is a reflective aluminum layer. As a result, the present provides for electrically coupling first plurality of substantially parallel spaced apart conductive ridges 1212 to a desired region of flat panel display device. As an example, in one embodiment, first plurality of substantially parallel spaced apart conductive ridges 1212 are then electrically coupled to charge draining structures present at the edge of the active region of the flat panel display device. In so doing, the present embodiment provides effective charge bleeding, prevents unwanted electron accumulation and achieves improved electrical robustness.

Thus, in the above embodiment, the present invention provides a black matrix formation method which meets the above-listed requirements, and which produces a black matrix which is electrically robust. That is, another embodiment of the present invention provides a black matrix formation method which produces a black matrix structure which is adapted to retain a support structure within a flat panel display device, and which exhibits desired electrical characteristics even under electron bombardment during operation of the flat panel display device.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the Claims appended hereto and their equivalents.

What is claimed is:

1. A multi-level matrix structure for retaining a support structure within a flat panel display device, said multi-level matrix structure comprising:

a first plurality of substantially parallel spaced apart ridges;

a second plurality of substantially parallel spaced apart ridges, said second plurality of substantially parallel spaced apart ridges oriented substantially orthogonally with respect to said first plurality of substantially parallel spaced apart ridges, said second plurality of substantially parallel spaced apart ridges having a height greater than the height of said first plurality of substantially parallel spaced apart ridges, said second plurality of parallel spaced apart ridges including contact portions for retaining a support structure at a desired location within a flat panel display device, wherein said contact portions of said second plurality of parallel spaced apart ridges are comprised of an undercut region of substrate beneath an extending region of cured polyimide material.

2. The multi-level matrix structure of claim 1 wherein said first and second plurality of substantially parallel spaced apart ridges are adapted to be disposed on the inner surface of a faceplate of said flat panel display device.

3. The multi-level matrix structure of claim 1 wherein said first and second plurality of substantially parallel spaced apart ridges are adapted to be disposed above a cathode of said flat panel display device.

4. The multi-level matrix structure of claim 1 wherein said contact portions are disposed such that two of said contact portions contact said support structure on opposing sides thereof.

5. The multi-level matrix structure of claim 1 wherein said contact portions include deformable ends which compress when pressed against said support structure.

6. The multi-level matrix structure of claim 1 wherein said contact portions include sharp ends which are adapted to be pressed against said support structure.

7. The multi-level matrix structure of claim 6 wherein said sharp ends are further adapted to cleanly cut through material disposed on said support structure such that said material does not substantially peel from said support structure as said support structure is forced against said contact portions.

8. The multi-level matrix structure of claim 1 wherein said first and second plurality of substantially parallel spaced apart ridges are encapsulated with a protective material.

9. The multi-level matrix structure of claim 1 wherein said first and second plurality of substantially parallel spaced apart ridges are encapsulated with silicon nitride.

10. The multi-level matrix structure of claim 1 wherein said support structure is disposed only between red subpixels and blue subpixels of said flat panel display device such that visibility of said support structure is minimized.

11. The multi-level matrix structure of claim 1 wherein said second plurality of substantially parallel spaced apart ridges are formed to a height of approximately 40–50 micrometers in a manner which provides for reduced shrinkage of the second plurality of substantially parallel spaced apart ridges and improved control over the height of the second plurality of substantially parallel spaced apart ridges.

12. The multi-level matrix structure of claim 1 further comprising:

a conductive base disposed beneath said first and second plurality of substantially parallel spaced apart ridges, said conductive base adapted to provide an electrical connection between at least one of said first and second plurality of substantially parallel spaced apart ridges and portions of said flat panel display device.

13. The multi-level matrix structure of claim 12 wherein said conductive base disposed beneath said first and second plurality of substantially parallel spaced apart ridges is comprised of a base layer of black chrome and a top layer of chrome.

14. The multi-level matrix structure of claim 1 wherein said contact portions of said second plurality of substantially parallel spaced apart ridges are adapted to frictionally retain said support structure at said desired location within said flat panel display device.

15. In a field emission display device, a multi-level matrix structure for retaining a support structure in a desired location and orientation within said field emission display device, said multi-level matrix structure comprising:

a first plurality of substantially parallel spaced apart ridges;

a second plurality of substantially parallel spaced apart ridges, said second plurality of substantially parallel spaced apart ridges oriented substantially orthogonally with respect to said first plurality of substantially parallel spaced apart ridges, said second plurality of substantially parallel spaced apart ridges having a height greater than the height of said first plurality of substantially parallel spaced apart ridges, said second plurality of parallel spaced apart ridges including contact portions for retaining a support structure at a desired location and orientation within a field emission display device, wherein said contact portions of said second plurality of parallel spaced apart ridges are comprised of an undercut region of substrate beneath an extending region of cured polyimide material.

16. The field emission display device of claim 15 wherein said first and second plurality of substantially parallel spaced apart ridges of said multi-level matrix structure are adapted to be disposed on an inner surface of a faceplate of said field emission display device.

17. The field emission display device of claim 15 wherein said first and second plurality of substantially parallel spaced apart ridges of said multi-level matrix structure are adapted to be disposed above a cathode of said field emission display device.

18. The field emission display device of claim 15 wherein said contact portions of said multi-level matrix structure are disposed such that two of said contact portions contact said support structure on opposing sides thereof.

19. The field emission display device of claim 15 wherein said contact portions of said multi-level matrix structure include deformable ends which compress when pressed against said support structure.

20. The field emission display device of claim 15 wherein said contact portions of said multi-level matrix structure include sharp ends which are adapted to be pressed against said support structure.

21. The field emission display device of claim 20 wherein said sharp ends of said multi-level matrix structure are further adapted to cleanly cut through material disposed on said support structure such that said material does not substantially peel from said support structure as said support structure is forced against said contact portions.

22. The field emission display device of claim 15 wherein said first and second plurality of substantially parallel spaced apart ridges are encapsulated with a protective material.

23. The field emission display device of claim 15 wherein said first and second plurality of substantially parallel spaced apart ridges are encapsulated with silicon nitride.

24. The field emission display device of claim 15 wherein said support structure is disposed only between red subpixels and blue subpixels of said field emission display device such that visibility of said support structure is minimized.

25. The field emission display device of claim 15 wherein said second plurality of substantially parallel spaced apart ridges are formed to a height of approximately 40–50 micrometers in a manner which provides for reduced shrinkage of the second plurality of substantially parallel spaced apart ridges and improved control over the height of the second plurality of substantially parallel spaced apart ridges.

26. The field emission display device of claim 15 further comprising:

a conductive base disposed beneath said first and second plurality of substantially parallel spaced apart ridges, said conductive base adapted to provide an electrical connection between at least one of said first and second plurality of substantially parallel spaced apart ridges and portions of said field emission display device.

27. The multi-level matrix structure of claim 26 wherein said conductive base disposed beneath said first and second plurality of substantially parallel spaced apart ridges is comprised of a base layer of black chrome and a top layer of chrome.

28. The field emission display device of claim 15 wherein said contact portions of said second plurality of substantially parallel spaced apart ridges of said multi-level matrix structure are adapted to frictionally retain said support structure at said desired location and orientation within said field emission display device.

29. A method for retaining a support structure within a flat panel display device, method comprising the steps of:

a) forming a multi-level matrix structure, said multi-level matrix structure comprising i) a first plurality of substantially parallel spaced apart ridges; and ii) a second plurality of substantially parallel spaced apart ridges, said second plurality of substantially parallel spaced apart ridges oriented substantially orthogonally with respect to said first plurality of substantially parallel spaced apart ridges, said second plurality of substantially parallel spaced apart ridges having a height greater than the height of said first plurality of substantially parallel spaced apart ridges, said second plurality of parallel spaced apart ridges including contact portions for retaining a support structure at a desired location within a flat panel display device, wherein said contact portions of said second plurality of parallel spaced apart ridges are comprised of an undercut region of substrate beneath an extending region of cured polyimide material; and b) inserting said support structure between at least two of said contact portions of said multi-level support structure such that said support structure is pressed between and retained by said contact portions at said desired location within said flat panel display device.

30. The method for retaining a support structure within a flat panel display device as recited in claim 29 wherein said step a) further comprises forming said multi-level matrix structure above an inner surface of a faceplate of said flat panel display device.

31. The method for retaining a support structure within a flat panel display device as recited in claim 29 wherein said step a) further comprises forming said multi-level matrix structure above a cathode of said flat panel display device.

32. The method for retaining a support structure within a flat panel display device as recited in claim 29 wherein said step a) further comprises forming said multi-level matrix structure such that said contact portions are disposed with two of said contact portions adapted to contact said support structure on opposing sides thereof.

33. The method for retaining a support structure within a flat panel display device as recited in claim 29 wherein said step a) further comprises forming said multi-level matrix structure such that said contact portions include deformable ends which compress when pressed against said support structure.

34. The method for retaining a support structure within a flat panel display device as recited in claim 29 wherein said step a) further comprises forming said multi-level matrix structure such that said contact portions include sharp ends which are adapted to be pressed against said support structure.

35. The method for retaining a support structure within a flat panel display device as recited in claim 34 wherein said sharp ends are adapted to cleanly cut through material disposed on said support structure such that said material does not substantially peel from said support structure as said support structure is inserted between at least two of said contact portions of said multi-level matrix structure.

36. The method for retaining a support structure within a flat panel display device as recited in claim 29 wherein step a) comprises forming said second plurality of substantially parallel spaced apart ridges to a height of approximately 40–50 micrometers in a manner which provides for reduced shrinkage of the second plurality of substantially parallel spaced apart ridges and improved control over the height of the second plurality of substantially parallel spaced apart ridges.

37. The method for retaining a support structure within a flat panel display device as recited in claim 29 further comprising the step of:

encapsulating said first and second plurality of substantially parallel spaced apart ridges with a protective material.

38. The method for retaining a support structure within a flat panel display device as recited in claim 29 further comprising the step of:

encapsulating said first and second plurality of substantially parallel spaced apart ridges with silicon nitride.

39. The method for retaining a support structure within a flat panel display device as recited in claim 29 wherein step b) comprises inserting said support structure only between red subpixels and blue subpixels of said flat panel display device such that visibility of said support structure is minimized.

40. The method for retaining a support structure within a flat panel display device as recited in claim 29 wherein prior to performing step a) said method further comprises the step of:

forming a conductive base to be disposed beneath said first and second plurality of substantially parallel spaced apart ridges, said conductive base adapted to provide an electrical connection between at least one of said first and second plurality of substantially parallel spaced apart ridges and portions of said flat panel display device.

41. The method for retaining a support structure within a flat panel display device as recited in claim 29 wherein prior to performing step a) said method further comprises the step of:

forming a conductive base having of a base layer of black chrome and a top layer of chrome, said conductive base to be disposed beneath said first and second plurality of substantially parallel spaced apart ridges, said conductive base adapted to provide an electrical connection between at least one of said first and second plurality of substantially parallel spaced apart ridges and portions of said flat panel display device.

42. The method for retaining a support structure within a flat panel display device as recited in claim 29 wherein said step b) comprises:

inserting said support structure between at least two of said contact portions of said multi-level support structure such that said support structure is pressed between and frictionally retained by said contact portions at said desired location within said flat panel display device.

43. A method for forming a contact portion of a matrix structure wherein said contact portion is adapted to retain a support structure within a flat panel display device, said method comprising the steps of:

a) disposing a polyimide precursor material upon a substrate to which cured polyimide material is strongly adherent;

b) subjecting said polyimide precursor material to a thermal imidization process such that an extending region of said cured polyimide material is formed proximate to said substrate; and c) selectively etching said substrate to undercut said substrate from beneath said extending region of said cured polyimide material, such that said extending region of said cured polyimide material comprises said contact portion of said matrix structure and is adapted to retain said support structure within said flat panel display device.

44. The method for forming a contact portion of a matrix structure as recited in claim 43, wherein said substrate is comprised of a dimensionally stable material.

45. The method for forming a contact portion of a matrix structure as recited in claim 44, wherein said dimensionally stable material is comprised of chromium.

46. The method for forming a contact portion of a matrix structure as recited in claim 44, wherein said dimensionally stable material is comprised of silica.

47. The method for forming a contact portion of a matrix structure as recited in claim 43, wherein said extending region of said cured polyimide material has a shape which is tailored to correspond to a shape of said support structure which will be retained by said contact portion within said flat panel display device.

48. The method for forming a contact portion of a matrix structure as recited in claim 43, wherein step c) comprises:

selectively etching said substrate to undercut said substrate from beneath said extending region of said cured polyimide material, such that said extending region of said cured polyimide material comprises said contact portion of said matrix structure and is adapted to frictionally retain said support structure within said flat panel display device.

49. A method for forming a multi-layer heterostructure contact portion of a matrix structure wherein said multi-layer heterostructure contact portion is adapted to retain a support structure within a flat panel display device, said method comprising the steps of:

a) disposing a polyimide precursor material upon a first surface of a first substrate to which cured polyimide material is strongly adherent;

b) subjecting said polyimide-precursor material to a thermal imidization process such that an extending region of said cured polyimide material is formed proximate to said first surface of said first substrate and a retracted region of said cured polyimide material is formed distant from said first surface of said first substrate; and c) selectively etching said substrate to undercut said substrate from beneath said extending region of said cured polyimide material, such that said extending region of said first surface of said first substrate comprises a first part of said multi-layer heterostructure contact portion of said matrix structure and is adapted to retain said support structure within said flat panel display device.

50. The method for forming a multi-layer heterostructure contact portion of a matrix structure as recited in claim 49, wherein said first substrate is comprised of a dimensionally stable material.

51. The method for forming a multi-layer heterostructure contact portion of a matrix structure as recited in claim 50, wherein said dimensionally stable material is comprised of chromium.

52. The method for forming a multi-layer heterostructure contact portion of a matrix structure as recited in claim 50, wherein said dimensionally stable material is comprised of silica.

53. The method for forming a multi-layer heterostructure contact portion of a matrix structure as recited in claim 49, wherein said first surface of said first substrate disposed proximate to said extending region of said cured polyimide material has a shape which is tailored to correspond to a shape of said support structure which will be retained by said contact portion within said flat panel display device.

54. The method for forming a multi-layer heterostructure contact portion of a matrix structure as recited in claim 49, further comprising the steps of:

c) disposing a second polyimide precursor material between said first substrate and a second substrate, said second polyimide precursor material contacting a second surface of said first substrate, said second surface of said first substrate opposing said first surface of said first substrate, said second surface of said first substrate and said surface of said second substrate comprised of material to which cured polyimide material is strongly adherent;

d) subjecting said second polyimide precursor material to a thermal imidization process such that an extending region of said cured polyimide material is formed proximate to said second surface of said first substrate and said surface of said second substrate, and a retracted region of said cured polyimide material is formed distant from said first surface of said first substrate, said second surface of said first substrate and said second substrate comprising a second part of said multi-layer heterostructure contact portion of said matrix structure for retaining said support structure within said flat panel display device.

55. The method for forming a multi-layer heterostructure contact portion of a matrix structure as recited in claim 54, wherein steps a) and c) are performed concurrently.

56. The method for forming a multi-layer heterostructure contact portion of a matrix structure as recited in claim 54, wherein steps b) and d) are performed concurrently.

57. The method for forming a multi-layer heterostructure contact portion of a matrix structure as recited in claim 54, wherein steps a) and c) are performed concurrently, and steps b) and d) are performed concurrently.

58. The method for forming a multi-layer heterostructure contact portion of a matrix structure as recited in claim 49, wherein step b) comprises:

subjecting said polyimide precursor material to a thermal imidization process such that an extending region of said cured polyimide material is formed proximate to said first surface of said first substrate and a retracted region of said cured polyimide material is formed distant from said first surface of said first substrate, said first surface of said first substrate comprising a first part of said multi-layer heterostructure contact portion of said matrix structure and is adapted to frictionally retain said support structure within said flat panel display device.

59. A method for forming an electrically robust multi-layer matrix structure wherein said electrically robust multi-layer matrix structure includes a contact portion adapted to retain a support structure within a flat panel display device, said method comprising the steps of:

a) forming a first plurality of substantially parallel spaced apart conductive ridges above a surface to be used within a flat panel display device;

b) forming a second plurality of substantially parallel spaced apart ridges above said surface to be used within a flat panel display device; said second plurality of substantially parallel spaced apart ridges oriented substantially orthogonally with respect to said first plurality of substantially parallel spaced apart conductive ridges, said second plurality of substantially parallel spaced apart ridges having a height greater than the height of said first plurality of substantially parallel spaced apart conductive ridges, said second plurality of parallel spaced apart ridges including contact portions for retaining a support structure at a desired location within said flat panel display device, wherein said contact portions of said second plurality of parallel spaced apart ridges are comprised of an undercut region of substrate beneath an extending region of cured polyimide material;

c) applying a dielectric material to said first plurality of substantially parallel spaced apart conductive ridges;

d) removing a portion of said dielectric material from said first plurality of substantially parallel spaced apart conductive ridges such that an exposed region of said first plurality of substantially parallel spaced apart conductive ridges is generated; and e) depositing a layer of conductive material over said first plurality of substantially parallel spaced apart conductive ridges such that said conductive material is electrically coupled to said exposed region of said first plurality of substantially parallel spaced apart conductive ridges.

60. The method for forming an electrically robust multi-layer matrix structure wherein said electrically robust multi-layer matrix structure includes a contact portion as recited in claim 59 wherein said first plurality of substantially parallel spaced apart conductive ridges are comprised of a base of black chrome and a body of chrome.

61. The method for forming an electrically robust multi-layer matrix structure wherein said electrically robust multi-layer matrix structure includes a contact portion as recited in claim 59 wherein said first plurality of substantially parallel spaced apart conductive ridges comprise rows of said electrically robust multi-layer matrix structure.

62. The method for forming an electrically robust multi-layer matrix structure wherein said electrically robust multi-layer matrix structure includes a contact portion as recited in claim 59 wherein said first plurality of substantially parallel spaced apart conductive ridges comprise columns of said electrically robust multi-layer matrix structure.

63. The method for forming an electrically robust multi-layer matrix structure wherein said electrically robust multi-layer matrix structure includes a contact portion as recited in claim 59 wherein said surface is a faceplate of flat panel display device.

64. The method for forming an electrically robust multi-layer matrix structure wherein said electrically robust multi-layer matrix structure includes a contact portion as recited in claim 63 wherein after step d) and prior to step e), said method further comprises the step of:

forming phosphor regions above said first surface between said first plurality of substantially parallel spaced apart conductive ridges and said second plurality of substantially parallel spaced apart ridges.

65. The method for forming an electrically robust multi-layer matrix structure wherein said electrically robust multi-layer matrix structure includes a contact portion as recited in claim 59 wherein said surface is a cathode of flat panel display device.

66. The method for forming an electrically robust multi-layer matrix structure wherein said electrically robust multi-layer matrix structure includes a contact portion as recited in claim 59 wherein said layer of conductive material is a reflective aluminum layer.

67. The method for forming an electrically robust multi-layer matrix structure wherein said electrically robust multi-layer matrix structure includes a contact portion as recited in claim 59 wherein said layer of conductive material is coupled to a desired region of said flat panel display device such that said first plurality of substantially parallel spaced apart conductive ridges are electrically coupled to said desired region of said flat panel display device.

68. The method for forming an electrically robust multi-layer matrix structure wherein said electrically robust multi-layer matrix structure includes a contact portion as recited in claim 59 wherein step b) comprises:

b) forming a second plurality of substantially parallel spaced apart ridges above said surface to be used within a flat panel display device; said second plurality of substantially parallel spaced apart ridges oriented substantially orthogonally with respect to said first plurality of substantially parallel spaced apart conductive ridges, said second plurality of substantially parallel spaced apart ridges having a height greater than the height of said first plurality of substantially parallel spaced apart conductive ridges, said second plurality of parallel spaced apart ridges including contact portions for frictionally retaining a support structure at a desired location within said flat panel display device.

* * * * *